US005252774A

United States Patent [19]

Hasebe et al.

[11] Patent Number: 5,252,774

[45] Date of Patent: Oct. 12, 1993

[54] ELECTRONIC MUSICAL INSTRUMENT HAVING RESONANCE TONE GENERATION

[75] Inventors: Masahiko Hasebe, Hamamatsu; Takeshi Adachi, Hamakita; Yoshihiro Inagaki, Hamamatsu, all of Japan

[73] Assignee: Yamaha Corporation, Hamamatsu, Japan

[21] Appl. No.: 785,510

[22] Filed: Oct. 30, 1991

[30] Foreign Application Priority Data

Oct. 31, 1990 [JP] Japan ..... 2-291874
Oct. 31, 1990 [JP] Japan ..... 2-291875

[51] Int. Cl.[5] ..... G10H 1/057; G10H 1/06; G10H 1/22; G10H 1/46

[52] U.S. Cl. ..... 84/618; 84/622; 84/626; 84/627; 84/633

[58] Field of Search ..... 84/609-615, 84/618, 633-638, 653, 656, 678, 684, 622-627

[56] References Cited

U.S. PATENT DOCUMENTS 4,342,248 8/1982 Deutsch et al. ..... 84/618 X
4,909,121 3/1990 Usa et al. ..... 84/622 X

FOREIGN PATENT DOCUMENTS 60-91393 5/1985 Japan .
60-91395 5/1985 Japan .
1-145697 6/1989 Japan .

*Primary Examiner*—Stanley J. Witkowski
*Attorney, Agent, or Firm*—Graham & James

[57] ABSTRACT

An electronic musical instrument including a keyboard, a CPU and a sound source. The keyboard designates a pitch of a musical tone. The CPU detects common pitch data of one of predetermined series of pitch data or interval between predetermined two pitches, when a plurality of pitches are designated by the keyboard. The predetermined series of pitch data are stored in a memory in units of pitches which can be designated by the keyboard. The sound source outputs a musical tone signal having a pitch designated by the keyboard and musical tone signals having pitches indicated by the common pitch data detected by the CPU or having pitches corresponding to the interval detected by the CPU.

9 Claims, 18 Drawing Sheets

| | OVERTONE | 2 | 3 | 4 | 5 | 6 | 7 | 8 | 9 | 10 | 11 |
|---|---|---|---|---|---|---|---|---|---|---|---|
| FUNPAMENTAL TONE | | | | | | | | | | | |
| | C1 | C2 | G2 | C3 | E3 | G3 | Bb3<br>A*3 | C4 | D4 | E4 | Gb4<br>F*4 |
| | E1 | E2 | B2 | E3 | Ab3<br>G*3 | B3 | D4 | E4 | Gb4<br>F*4 | Ab4<br>G*4 | Bb4<br>A*4 |

FIG. 10

MSB

| | |
|---|---|
| 1/0 | KCNK 1 |
| 0 | KCNK 2 |

FIG. 12

MSB

| | | | |
|---|---|---|---|
| 1/0 | UKCm3 | ¥1 | UPWARD MINOR THIRD |
| | UKCm3 | ¥2 | |
| | UKCm3 | ¥3 | |
| | UKCM3 | ¥1 | UPWARD MAJOR THIRD |
| | UKCM3 | ¥2 | |
| | UKCM3 | ¥3 | |
| | UKCP4 | ¥1 | UPWARD PERFECT FOURTH |
| | UKCP4 | ¥2 | |
| | UKCP4 | ¥3 | |
| | UKCP5 | ¥1 | UPWARD PERFECT FIFTH |
| | UKCP5 | ¥2 | |
| | UKCP5 | ¥3 | |
| | DKCm3 | ¥1 | DOWNWARD MINOR THIRD |
| | DKCm3 | ¥2 | |
| | DKCm3 | ¥3 | |
| | DKCM3 | ¥1 | DOWNWARD MAJOR THIRD |
| | DKCM3 | ¥2 | |
| | DKCM3 | ¥3 | |
| | DKCP4 | ¥1 | DOWNWARD PERFECT FOURTH |
| | DKCP4 | ¥2 | |
| | DKCP4 | ¥3 | |
| | DKCP5 | ¥1 | DOWNWARD PERFECT FIFTH |
| | DKCP5 | ¥2 | |
| 1/0 | DKCP5 | ¥3 | |

FIG. 13

ELECTRONIC MUSICAL INSTRUMENT HAVING RESONANCE TONE GENERATION

BACKGROUND OF THE INVENTION

Field of the Invention

The present invention relates to an electronic musical instrument which can obtain real tones approximate to those of acoustic instruments and, more particularly, to an electronic musical instrument which can obtain the same resonance effect as that of acoustic instruments.

Description of the Related Art

Conventionally, in order to obtain real tones approximate to those of acoustic instruments, an electronic musical instrument which simultaneously produces resonance tones having predetermined pitches corresponding to a pitch of a musical tone to be generated is known.

For example, Japanese Patent application Laid-Open No. Sho 60-91393 discloses an electronic musical instrument which produces resonance tones according to a pitch of a tone to be generated in response to a key ON event so as to have a low volume level and a long release time. If, for example, an originally designated pitch (ON key) is a key C4, an electronic musical instrument of this type generates data indicating pitches of C2, F2, C3, C5, G5, C6, E6, G6, and C7 as resonance pitch data having frequencies $\frac{1}{4}$, $\frac{1}{3}$, $\frac{1}{2}$, 2, 3, 4, 5, 6, 8 times the frequency of the designated pitch, and produces resonance tones having these pitches.

In this electronic musical instrument, since resonance tones having predetermined pitches corresponding to an ON key are simply produced in units of key ON events, when a plurality of keys are depressed, a plurality of channels are independently produce resonance tones. Therefore, a large number of channels are necessary. When a plurality of keys are depressed, resonance tones are generated according to ON keys as long as there are empty channels. Since these resonance tones are independently produced without any restriction, chord tones tend to discord.

Japanese Patent application Laid-Open No. Sho 60-91395 discloses an electronic musical instrument which stores in advance waveforms of resonance tones in a waveform memory, selects and reads out waveform data of resonance tones from the waveform memory in accordance with a pitch of an ON key or chord tones, and produces resonance tones.

When resonance tones are produced according to chord tones, in a performance wherein a melody is superposed on chord tones, as shown in a music score in FIG. 18, given resonance tone components can only be added according to chord tones during this measure, and the sound of the chord tones undesirably becomes monotonous.

SUMMARY OF THE INVENTION

The present invention has been made in consideration of the conventional problems, and has as its first object to provide an electronic musical instrument which can decrease the required number of channels, and can prevent chord tones from being discordant.

It is the second object of the present invention to provide an electronic musical instrument which can prevent chord tones from being discordant, and can obtain not monotonous but colorful sound.

In order to achieve the first object, according to the first aspect of the present invention, there is provided an electronic musical instrument comprising pitch designation means for designating a pitch of a musical tone signal to be generated, storage means for storing series of pitch data in units of pitches which can be designated by the pitch designation means, detection means for, when a plurality of pitches are designated by the pitch designation means, detecting common pitch data from the series of pitch data stored in units of the designated pitches by the storage means, and musical tone signal output means for outputting a musical tone signal having a pitch designated by the pitch designation means, and outputting musical tone signal having a pitch indicated by the common pitch data detected by the detection means.

The detection means may detect the frequencies of occurrence of common pitch data of the series of pitch data in units of the plurality of designated pitches, and the musical tone signal output means may add a characteristic (e.g., a tone volume) according to the frequencies of occurrence of common pitches to the musical tone signals having the pitches indicated by the common pitch data, and may output the obtained musical tone signals.

With this arrangement, an operator designates a pitch of a musical tone to be generated using the pitch designation means, e.g., a keyboard. A musical tone signal having the designated pitch is output and produced as an actual sound by the musical tone signal output means. On the other hand, series of pitch data are stored in the storage means in correspondence with pitches which can be designated by the pitch designation means. When a plurality of pitches ar designated, the detection means looks up the stored series of pitch data in units of the designated pitches, and detects common pitch data. Musical tones having indicated by the common pitch data are produced by the musical tone signal output means. Thus, a series of pitch data which may be produced as resonance tones in correspondence with each pitch are stored, and when a plurality of pitches are designated, resonance tones indicated by the common pitch data of these resonance tones can be actually produced.

Furthermore, when common pitch data are detected from the series of pitch data, frequencies of occurrence of the common pitch data may also be detected, and musical tones having pitches indicated by the common pitch data may be produced to have a predetermined characteristic, e.g., a predetermined tone volume, according to the detected frequencies of occurrence.

In order to achieve the second object, according to the second aspect of the present invention, there is provided an electronic musical instrument comprising pitch designation means for designating a pitch of a musical tone signal to be generated, detection means for, when a plurality of pitches are designated by the pitch designation means, detecting an interval between predetermined two pitches of the plurality of pitches, and musical tone signal output means for outputting a musical tone signal having a pitch designated by the pitch designation means, and outputting musical tone signal having a pitch corresponding to the interval detected by the detection means.

Note that the detection means can use, as a reference pitch, a newly designated pitch, the highest one of a plurality of designated pitches, and the lowest one of a plurality of designated pitches, and can detect an interval between the reference pitch and another designated pitch.

With this arrangement, an operator designates a pitch of a musical tone to be generated using the pitch designation means, e.g., a keyboard. A musical tone signal having the designated pitch is output and produced as an actual sound by the musical tone signal output means. On the other hand, the detection means detects an interval between predetermined two pitches of a plurality of designated pitches. Musical tone signals having pitches corresponding to the detected interval are produced by the musical tone signal output means. Thus, resonance tones according to the interval relationship can be actually produced.

If a newly designated pitch is used as a reference pitch, and an interval between this reference pitch and another designated pitch is detected, resonance tones can always be produced according to a music flow, thus preventing generation of a monotonous sound. If the highest one of a plurality of designated pitches is used as a reference pitch, a change in sound corresponding to a change in melody can be obtained. Furthermore, if the lowest one of a plurality of designated pitches is used as a reference pitch, the depth of sound can be emphasized while preventing a discordant sound of chord tones.

BRIEF DESCRIPTION OF THE DRAWINGS

FIG. 10 shows natural harmonic series of a tone of a pitch name C1, and a tone of a pitch name E1, which tones have the major third interval relationship;

FIG. 12 shows the principle of a key code buffer for ON key tones;

FIG. 13 shows the principle of a key code buffer for resonance tones for storing key codes of resonance tones corresponding to respective intervals;

DETAILED DESCRIPTION OF THE PREFERRED EMBODIMENTS

First Embodiment

An embodiment of the present invention will be described below with reference to the accompanying drawings.

Figure 1:
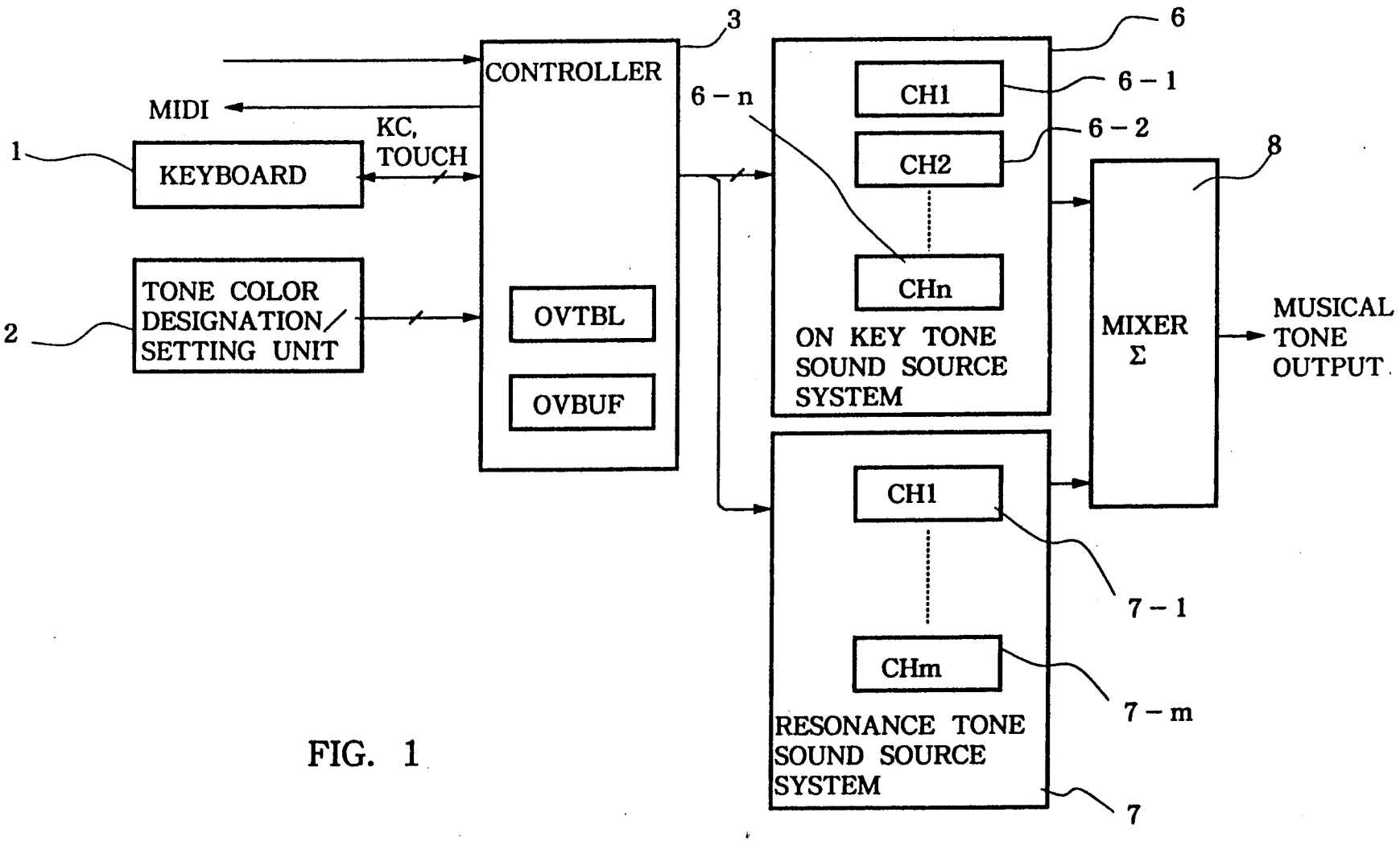
FIG. 1 is a block diagram of an electronic musical instrument according to an embodiment of the present invention.

FIG. 1 is a block diagram of an electronic musical instrument according to an embodiment of the present invention. The electronic musical instrument shown in FIG. 1 comprises a keyboard 1 and a pitch designation/setting unit 2. The keyboard 1 and the unit 2 are connected to a controller 3. A key code KC and touch data TOUCH according to an ON key are inputted from the keyboard 1 to the controller 3. The controller 3 has an MIDI interface. The controller 3 includes an overtone table OVTBL, and a data buffer OVBUF. More specifically, the controller 3 comprises a central processing unit (CPU), a random-access memory (RAM), and the like (not shown), and is operated according to flow charts (to be described later). The controller 3 outputs musical tone signal data corresponding to a key code KC designated by an ON key on the keyboard 1, and musical tone signal data of resonance tones. These outputs are supplied to an ON key tone sound source system 6, and a resonance tone sound source system 7. The ON key tone sound source system 6 includes n tone generation channels 6-1, 6-2, . . . , 6-n. The resonance tone sound source system 7 includes m tone generation channels 7-1, . . . , 7-m. Output signals from these sound source systems 6 and 7 are inputted to a mixer 8, and are acoustically mixed. Thereafter, the mixed signal is produced as actual musical tones via, e.g., a sound system.

The basic arrangement of one tone generation channel in the sound source system will be described below with reference to FIG. 2.

Figure 2:
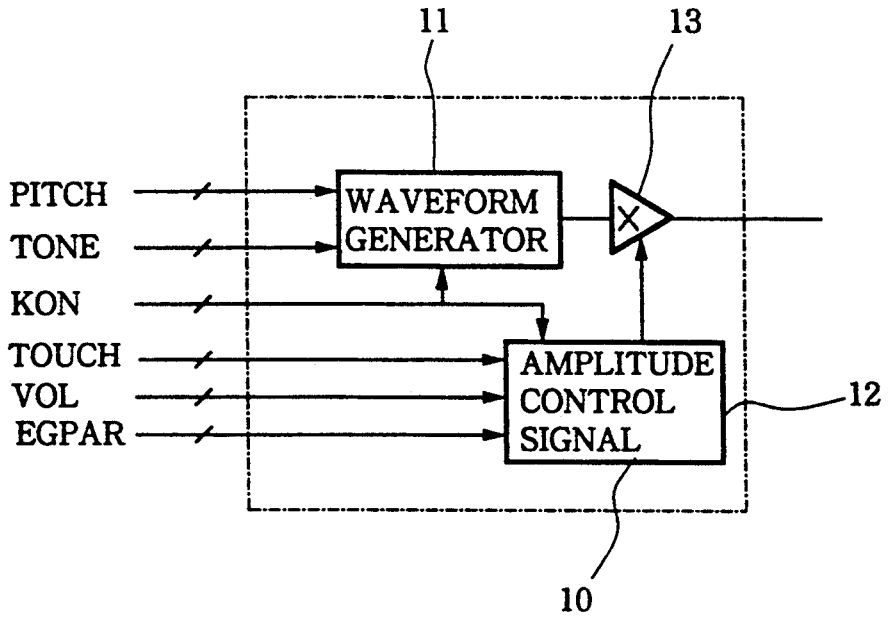
FIG. 2 is a diagram showing a basic arrangement of one tone generation channel in a sound source system of the electronic musical instrument shown in FIG. 1.

Each of the channels 6-1, . . . , 6-n, 7-1, . . . , 7-m in the sound source systems has an arrangement like in a channel 10 shown in FIG. 2. One channel 10 comprises a waveform generator 11 for generating a waveform of a musical tone signal, an amplitude control signal generator 12 for generating an amplitude control signal for controlling the amplitude of a musical tone signal, a multiplier 13 for shaping the output waveform from the waveform generator 11 with the amplitude control signal from the amplitude control signal generator 12, and the like. The waveform generator 11 receives pitch data (key code) PITCH, and tone color data TONE, and generates a waveform on the basis of these data. A key ON signal KON is inputted to both the waveform generator 11 and the amplitude control signal generator 12. Touch data TOUCH, tone volume data VOL, and a parameter EGPAR for an envelope generator are inputted to the amplitude control signal generator 12. The amplitude control signal generator 12 generates the amplitude control signal on the basis of these input signals.

The overtone table and the data buffer in the controller 3 will be described below.

Figure 3:
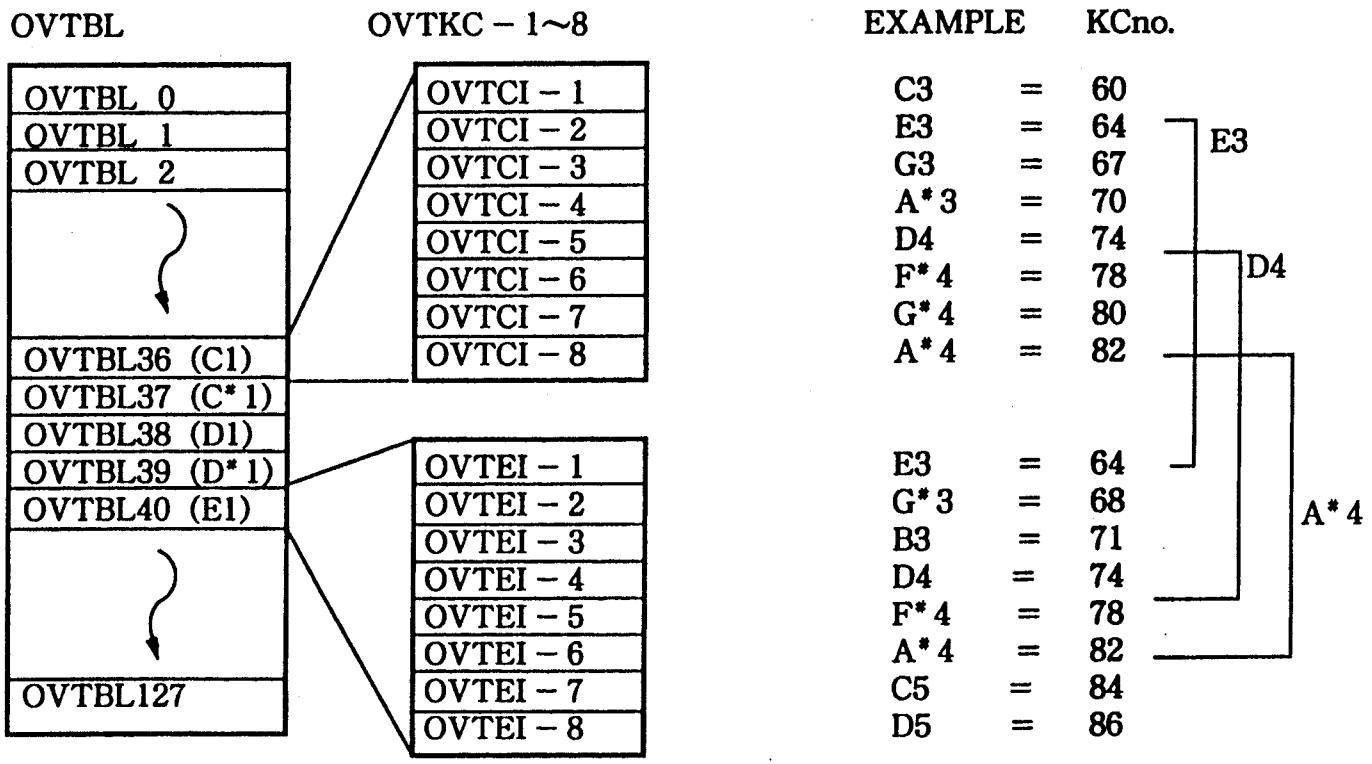
FIG. 3 shows the principle of an overtone table OVTBL.

FIG. 3 shows the principle of the overtone table OVTBL. The overtone table OVTBL has 128 storage areas respectively corresponding to pitches (i.e., key codes KC) which can be designated by the keyboard 1 of the electronic musical instrument. These storage areas will be called OVTBL0, OVTBL1, . . . , OVTBL127 in turn. One storage area OVTBLi (i=0 to 127) corresponding to one key code has eight storage regions. FIG. 3 shows eight storage regions corresponding to a pitch name C1 (a key code KC=36), and those corresponding to a pitch name E1 (a key code KC=40). The eight storage regions corresponding to the pitch name C1 will be called OVTC1-1, . . . , OVTC1-8. Similarly, the eight storage regions corresponding to the pitch name E1 will be called OVTE1-1, . . . , OVTE1-8. Eight storage regions corresponding to a key code KC will be generally called OVTKC-1, . . ., OVTKC-8.

Eight overtone key codes having an overtone relationship with a key code KC are selected and set in these storage regions OVTKC-1, . . . , OVTKC-8. For example, key codes having an overtone relationship with the pitch name C1 are set in the regions OVTC1-1, . . . , OVTC1-8 corresponding to the pitch name C1, as shown in Table 1 below. Similarly, key codes having an overtone relationship with the pitch name E1 are set in the regions OVTE1-1, . . . , OVTE1-8 corresponding to the pitch name E1, as shown in Table 2 below. These eight key codes are those of a series of musical tones which may be produced as resonance tones when tone generation of the corresponding key code KC is designated.

TABLE 1

| Storage Region | Set Key Code | Pitch Name |
|---|---|---|
| OVTC1-1 | 60 | C3 |
| OVTC1-2 | 64 | E3 |
| OVTC1-3 | 67 | G3 |
| OVTC1-4 | 70 | A#3 |
| OVTC1-5 | 74 | D4 |
| OVTC1-6 | 78 | F#4 |
| OVTC1-7 | 80 | G#4 |
| OVTC1-8 | 82 | A#4 |

TABLE 2

| Storage Region | Set Key Code | Pitch Name |
|---|---|---|
| OVTE1-1 | 64 | E3 |
| OVTE1-2 | 68 | G#3 |
| OVTE1-3 | 71 | B3 |
| OVTE1-4 | 74 | D4 |
| OVTE1-5 | 78 | F#4 |
| OVTE1-6 | 82 | A#4 |
| OVTE1-7 | 84 | C5 |
| OVTE1-8 | 86 | D5 |

Figure 4:
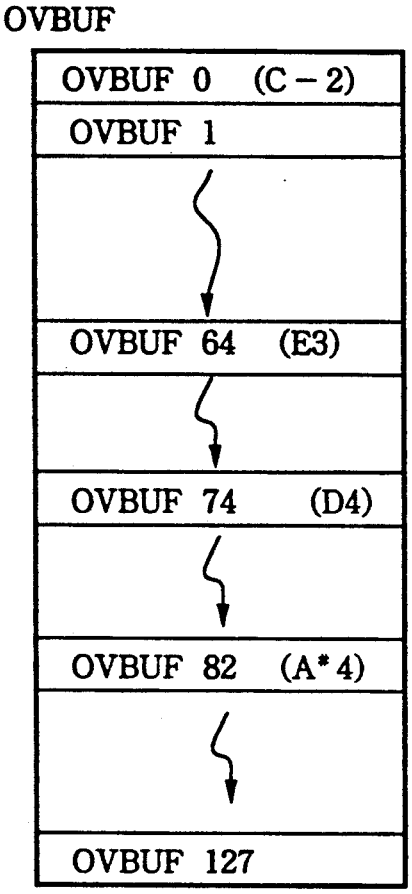
FIG. 4 shows the principle of a data buffer OVBUF.

FIG. 4 shows the principle of the data buffer OVBUF. The data buffer OVBUF has 128 elements respectively corresponding to pitches which can be subjected to tone generation in this electronic musical instrument. These elements will be called OVBUF0, OVBUF1, . . ., OVBUF127 in turn. The initial values of all these elements are "0". When a key corresponding to a given key code is depressed, an overtone table OVTBL corresponding to the key code is looked up, thereby obtaining predetermined eight overtone key codes. The values of the elements of the data buffer OVBUF corresponding to the obtained overtone key codes are incremented. On the contrary, when a key OFF event occurs, the values of the elements are decremented.

The operations of the controller 3 of this electronic musical instrument will be described below with reference to FIGS. 5 and 6.

Figure 5:
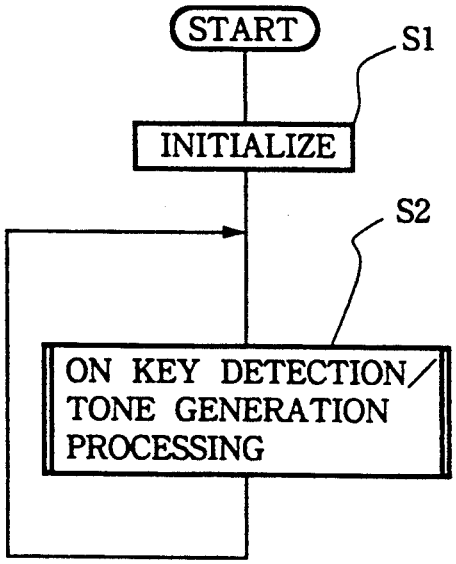
FIG. 5 is a flow chart showing a main routine of a controller of the electronic musical instrument shown in FIG. 1.
Figure 6:
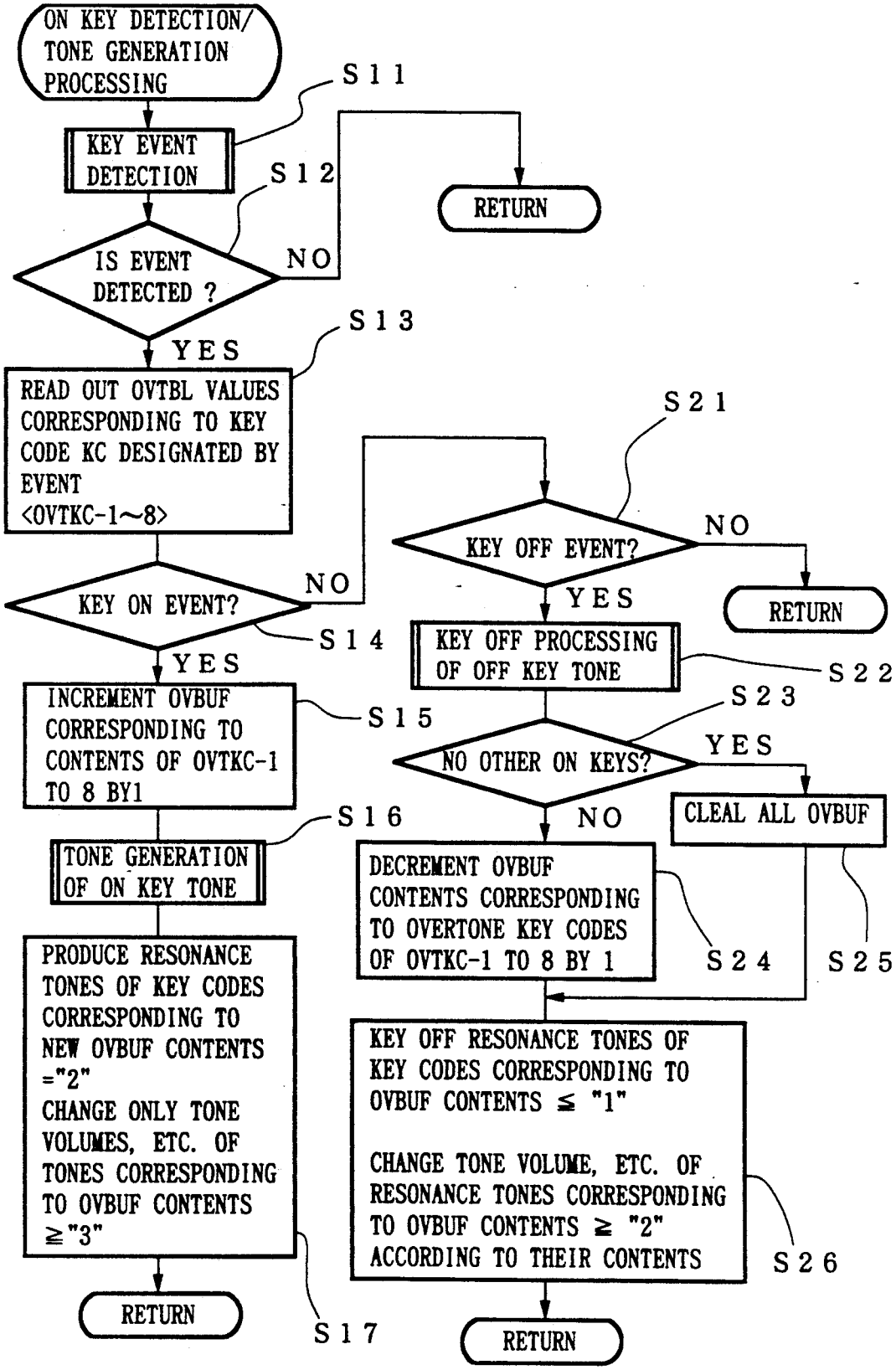
FIG. 6 is a flow chart showing an ON key detection/-tone generation processing routine of the controller of this electronic musical instrument.

FIG. 5 shows the main routine of the controller 3 of the electronic musical instrument. When the operation of the controller 3 is started, the registers, tables, and the like are initialized in step S1. Key codes associated with harmonic overtones corresponding to key codes are set in the overtone tables OVTBL. All the 128 elements of the data buffer OVBUF are cleared to zero. After step S1, ON key detection/tone generation processing is executed in step S2, and upon completion of this processing, the flow returns to step S2 to repeat it.

The ON key detection/tone generation processing will be described below with reference to FIG. 6. In the ON key detection/tone generation processing, a state of each key on the keyboard 1 is checked in step S11. It is then checked in step S12 if a key ON or OFF event is detected. If N (NO) in step S12, the flow returns to the main routine; otherwise, the flow advances to step S13.

In step S13, eight overtone key codes OVTKC-1 to OVTKC-8 of an overtone table OVTBL corresponding to a key code KC of the detected key event are read out. In step S14, it is checked if the detected key event is a key ON event. If Y (YES) in step S14, the flow advances to step S15; otherwise, the flow advances to step S21.

If Y in step S14, eight elements in the data buffer OVBUF corresponding to the eight overtone key codes OVTKC-1 to OVTKC-8 are incremented (+1) in step S15. In step S16, the key code KC (ON key tone) corresponding to the key ON event is produced. In step S17, the data buffer OVBUF is looked up to detect elements whose values have newly become equal to or larger than "2", and corresponding key code tones are produced as resonance tones. Furthermore, as for elements whose values are equal to or larger than "3" of the buffer OVBUF, only the tone volumes of corresponding key code tones are changed. Thereafter, the flow returns to the main routine.

If it is determined in step S14 that the detected key event is not a key ON event, it is checked in step S21 if the detected key event is a key OFF event. If Y in step S21, the flow advances to step S22; otherwise, the flow returns to the main routine.

If Y in step S21, key OFF processing of a tone of a key code KC corresponding to the key OFF event is executed in step S22. In step S23, it is checked if no other ON keys remain after the key OFF event. If N in step S23, eight elements of the data buffer OVBUF corresponding to the eight overtone key codes OVTKC-1 to OVTKC-8 are decremented (−1) in step S24.

In step S26, the data buffer OVBUF is looked up to detect elements whose values have newly become equal to or smaller than "1", and key OFF processing of resonance tones of corresponding key codes (being produced as resonance tones) is executed. Furthermore, as for elements whose values are equal to or larger than "2" of the buffer OVBUF, only the tone volumes of corresponding key code tones are changed according to their values. Thereafter, the flow returns to the main routine.

On the other hand, if no other ON keys are detected in step S23, since this means that none of keys on the keyboard 1 are depressed, all the elements of the data buffer OVBUF are cleared to zero in step S25, and the flow advances to step S26.

The above-mentioned processing will be exemplified below using an example shown in FIG. 3. Assume that a key of the pitch name C1 is depressed from a state wherein all the keys are OFF. At this time, the controller 3 reads out eight overtone key codes OVTC1-1 to OVTC1-8 of a table OVTBL36 on the basis of a key code KC=36 of the pitch name C1 (step S13). Since these values are key code values shown in FIG. 3 (table 1), eight elements OVBUF60, OVBUF64, . . . , OVBUF82 in the data buffer corresponding to the overtone key codes OVTC1-1 to OVTC1-8 are incremented (step S15). As a result, the values of these eight elements OVBUF60, OVBUF64, . . . , OVBUF82 in the data buffer become "1". In this state, no resonance tones are generated since no elements of the data buffer exceed "2" (step S17).

Assume that a key of the pitch name E1 is depressed while the key of the pitch name C1 is kept depressed. At this time, the controller 3 reads out eight overtone key codes OVTE1-1 to OVTE1-8 of a table OVTBL40 on the basis of a key code KC=40 of the pitch name E1 (step S13). Since these values are key code values shown in FIG. 3 (table 2), eight elements OVBUF64, OVBUF68, . . . , OVBUF86 in the data buffer corresponding to the overtone key codes OVTE1-1 to OVTE1-8 are incremented (step S15). As a result, the values of elements common to the key codes OVTC1-1 to OVTC1-8, and the key codes OVTE1-1 to OVTE1-8, i.e., the values of the elements OVBUF64, OVBUF74, and OVBUF82 corresponding to the pitch name E3 (key code=64), the pitch name D4 (key code=74), and the pitch name A#4 (key code=82) become "2". Then, these key code tones are produced as resonance tones in step S17.

According to the above-mentioned embodiment, overtone key codes (key codes which may be produced as resonance tones) of overtone tables corresponding to key codes of ON keys are looked up to detect overtone key codes common to a plurality of ON keys, and the detected overtone key codes are produced as resonance tones. Therefore, resonance tones can be produced using a smaller number of channels, and chord tones can be prevented from being discordant. Since the tone volumes of the resonance tones are changed according to the number of common key codes (the tone volumes are increased as the number of common key codes is larger), natural resonance tones can be obtained.

Not only pitch data of resonance tones but also designation data of tone volumes, tone colors, and the like upon production of tones may be set in each overtone table, and characteristics of resonance tones may be changed using these data. In the key OFF processing, resonance tones corresponding to the number of common key codes ≦"1" are subjected to key OFF processing (step S26). However, tone generation of resonance tones may be continued until the number of common key codes becomes "0". Especially, in an electronic musical instrument which simulates tones of a pipe organ, it is preferable to continue tone generation of resonance tones until the number of common key codes becomes "0". In this case, control may be made to decrease the tone volumes of resonance tones as the number of common key codes decreases.

Furthermore, in this embodiment, the ON key tone generation sound source and the resonance tone generation sound source are separately prepared. However, channel assignment processing of ON key tones and resonance tones may be properly executed, and an integrated sound source may be used.

As described above, according to the first aspect of the present invention, a series of pitch data (e.g., pitches which may be produced as resonance tones) are stored in units of pitches which can be designated, and when a plurality of pitches are designated, common ones of series of pitch data corresponding to the designated pitches are detected, and musical tone signals are outputted. Therefore, the number of required channels can be decreased, and chord tones can be prevented from being discordant. When characteristics such as tone volumes, tone colors, and the like are changed in accordance with the frequencies of occurrence of common pitches, natural musical tones can be produced.

Second Embodiment

Figure 7:
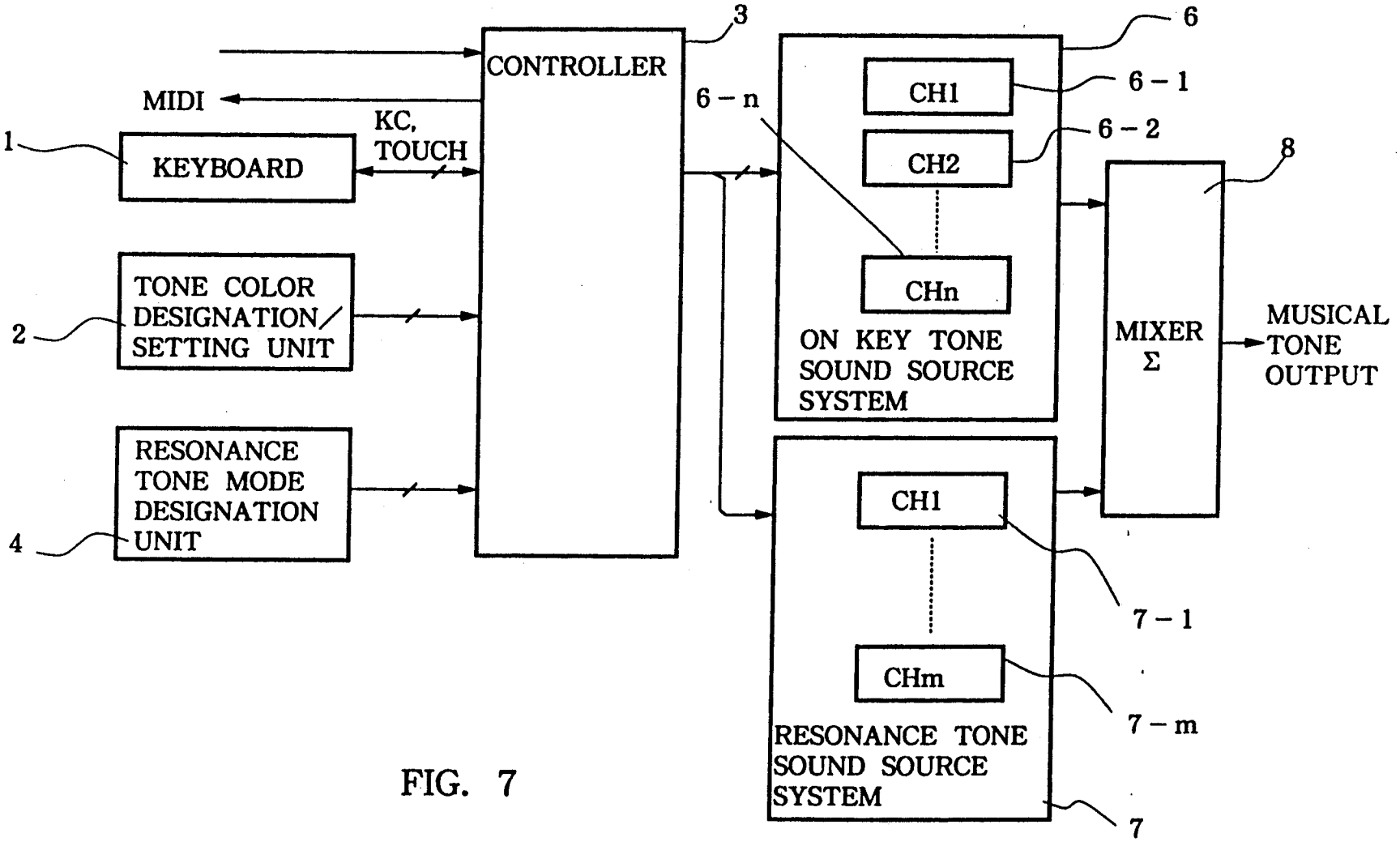
FIG. 7 is a block diagram of an electronic musical instrument according to another embodiment of the present invention.

FIG. 7 shows an embodiment of an electronic musical instrument according to the second aspect of the present invention. The electronic musical instrument shown in FIG. 7 has substantially the same hardware arrangement as that shown in FIG. 1, except that a resonance tone mode designation unit 4 is added. Channels in sound source systems 6 and 7 also have the same arrangement, as shown in FIG. 2. However, software programs such as a control program for operating a controller 3, coefficient tables, buffers, and the like allocated in the controller 3, and the like are different from those in the first embodiment. These coefficient tables, buffers, and control program will be described later.

Figure 8:
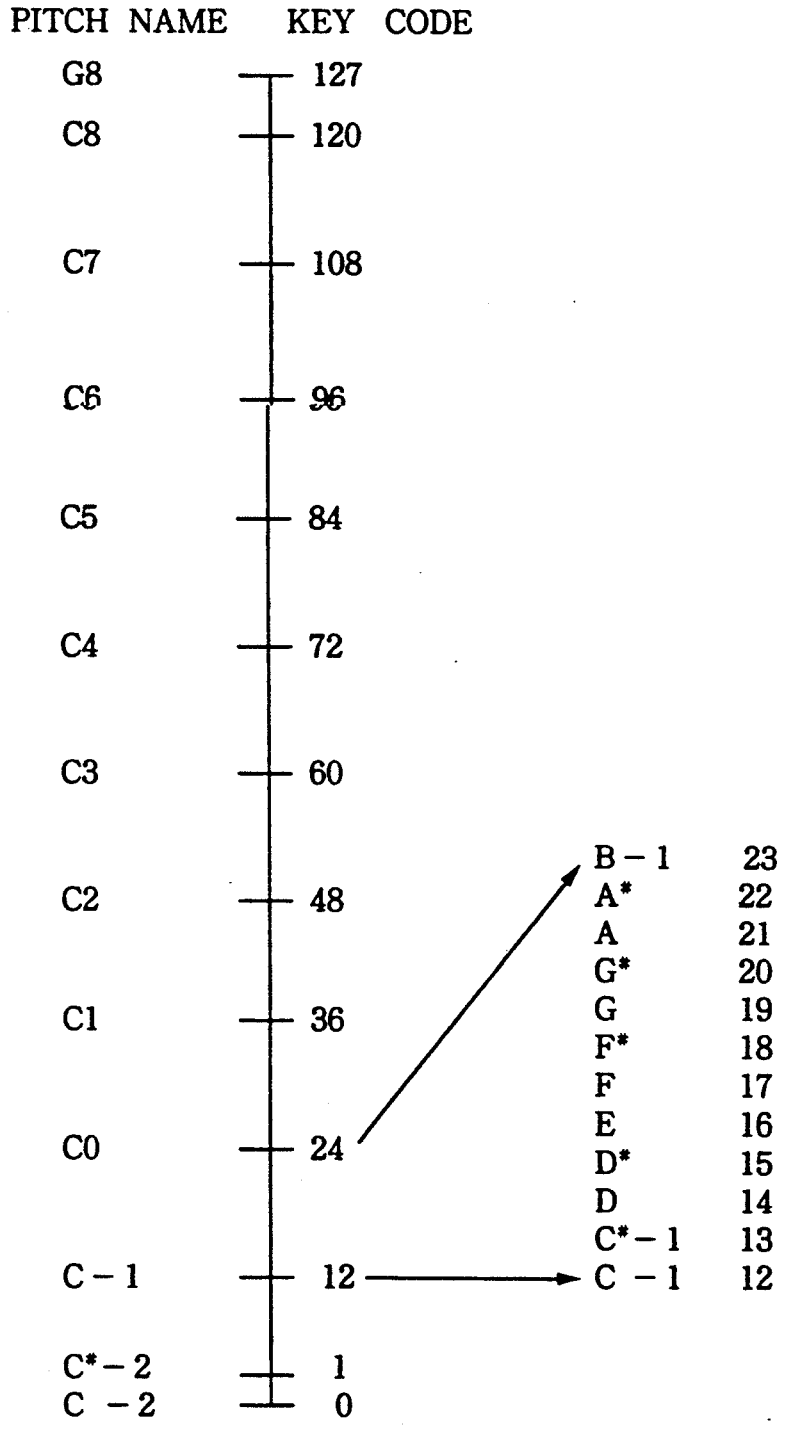
FIG. 8 shows a correspondence between key codes and pitch names in the electronic musical instrument shown in FIG. 7.

FIG. 8 shows a correspondence between key codes and pitch names in the electronic musical instrument of this embodiment. A key code of a tone having the pitch name C-2 is represented by "0", and the key code is increased by "1" as the pitch is increased by a semitone. Since there are 12 tones within an octave at semitone-intervals, a key code of the pitch name C-1 is represented by "12", a key code of the pitch name C0 is represented by "24", a key code of the pitch name C1 is represented by "36", . . . , and a key code of the pitch name C8 is by "120". FIG. 8 exemplifies key codes of tones within one octave between the pitch names C-1 and C0. Although not shown, key codes are similarly assigned to other octaves. The upper limit of a key code is assumed to be "127" corresponding to the pitch name G8.

Referring back to FIG. 7, an operator can designate a tone color using a tone color designation/setting unit 2. The operator can also select and set one of three resonance tone modes using the resonance tone mode designation unit 4. The three resonance tone modes will be described later.

The principle of a method of producing resonance tones in the electronic musical instrument of this embodiment will be described below.

In the electronic musical instrument of this embodiment, one reference tone is determined from all the ON key tones, and an interval between the reference tone and another ON key tone is detected. Musical tone signals of resonance tones are generated on the basis of the detected interval. Upon determination of the reference tone, the three resonance tone modes are available. The resonance tone mode can be selected and set by the resonance tone mode designation unit 4 shown in FIG. 7. These resonance tone modes will be described below.

(A) First Resonance Tone Mode (New ON Key Mode)

In the new ON key mode as the first resonance tone mode, a tone of a new ON key is determined as the reference tone. Therefore, an interval between the new ON key tone and another ON key tone is detected, and musical tone signals of resonance tones are generated on the basis of the detected interval. Since resonance tone generation processing is executed every time a new ON key is detected, the produced sound can be prevented from being monotonous.

(B) Second Resonance Tone Mode (Highest Tone Mode)

In the highest tone mode as the second resonance tone mode, a tone having the highest pitch (highest tone) of all the ON key tones at that time is determined as the reference tone. Therefore, an interval between the highest tone and another ON key tone is detected, and musical tone signals of resonance tones are generated on the basis of the detected interval. Since the highest tone is often a melody tone, a change in sound corresponding to a change in melody can be obtained.

(C) Third Resonance Tone Mode (Lowest Tone Mode)

In the lowest tone mode as the third resonance tone mode, a tone having the lowest pitch (lowest tone) of all the ON key tones at that time is determined as the reference tone. Therefore, an interval between the lowest tone and another ON key tone is detected, and musical tone signals of resonance tones are generated on the basis of the detected interval. A change in sound based on the lowest tones can be obtained, and the depth of sound can be emphasized while preventing a discordant sound of chord tones.

In the electronic musical instrument of this embodiment, it is detected whether or not there are ON keys whose pitches have upward and downward minor third, major third, perfect fourth, and perfect fifth interval relationships with the reference tone. If these interval relationships are detected, musical tone signals of resonance tones are generated according to the detected relationships.

Figure 9:
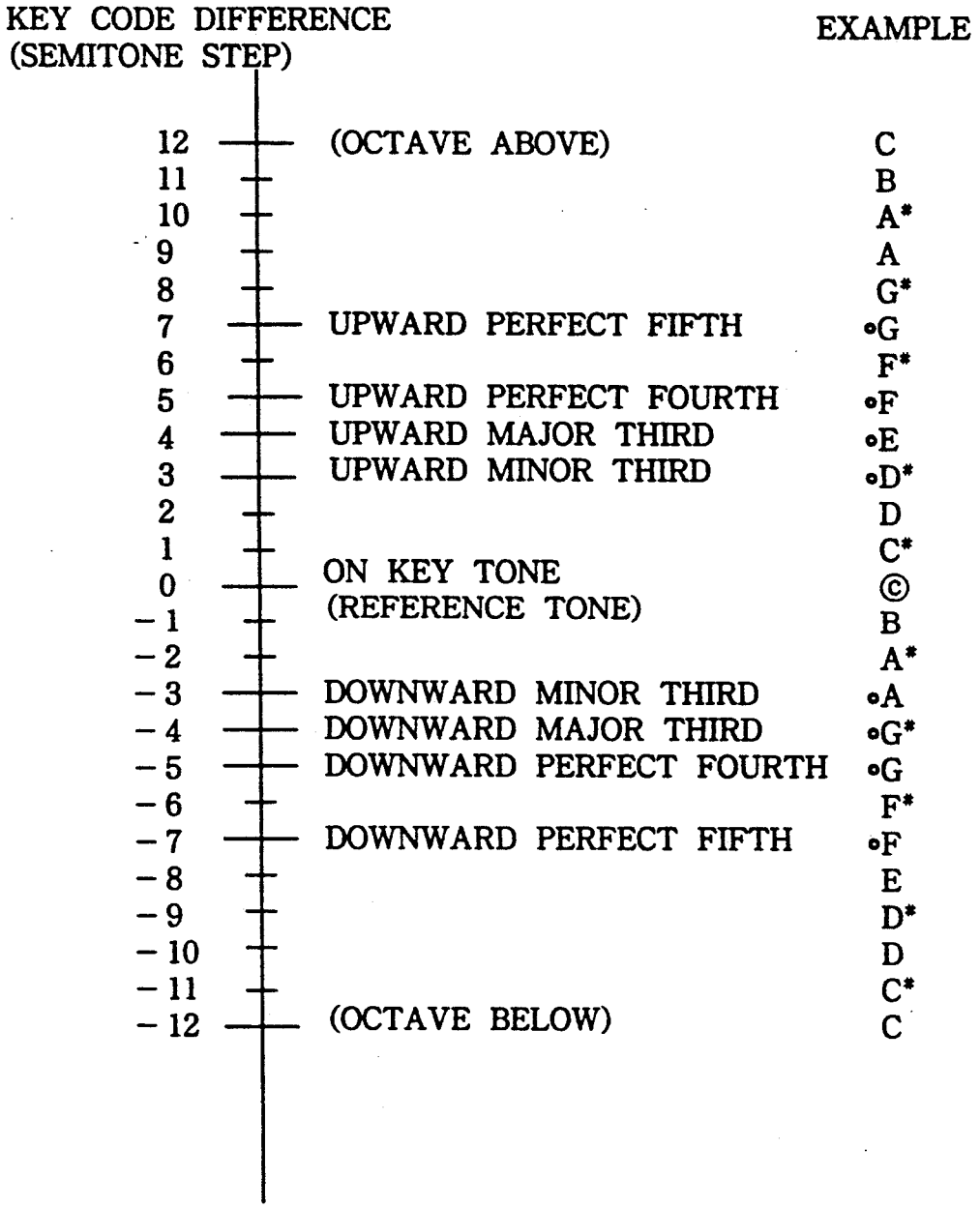
FIG. 9 shows interval relationships to be detected which are plotted on a scale in units of semitones.

FIG. 9 shows these interval relationships plotted along a scale in units of semitones. An ON key tone as a reference tone is represented by "0", an interval relationship between the reference tone and a tone higher than that by three semitones will be called "upward minor third", an interval relationship between the reference tone and a tone higher than that by four semitones will be called "upward major third", an interval relationship between the reference tone and a tone higher than that by five semitones will be called "perfect fourth", and an interval relationship between the reference tone and a tone higher than that by seven semitones will be called "perfect fifth". Similarly, an ON key tone as a reference tone is represented by "0", an interval relationship between the reference tone and a tone lower than that by three semitones will be called "downward minor third", an interval relationship between the reference tone and a tone lower than that by four semitones will be called "downward major third", an interval relationship between the reference tone and a tone lower than that by five semitones will be called "perfect fourth", and an interval relationship between the reference tone and a tone lower than that by seven semitones will be called "perfect fifth". FIG. 9 exemplifies pitch names corresponding to the respective interval relationships when the pitch name of a reference tone is C. The interval relationship between a given ON key tone and a reference tone can be detected based on a value obtained by subtracting the key code of the reference tone from the key code of the ON key tone. If this difference is "3", the interval relationship is "upward minor third"; if it is "4", "upward major third"; if it is "5", "upward perfect fourth"; and if it is "7", "upward perfect fifth". If the difference is "−3", the interval relationship is "downward minor third"; if it is "−4", "downward major third"; if it is "−5", "downward perfect fourth"; and if it is "−7", "downward perfect fifth".

When these interval relationships are detected, key codes of resonance tones to be produced can be calculated by adding a predetermined value to the key code of a reference tone. A method of calculating key codes of resonance tones on the basis of the interval relationships will be described below.

FIG. 10 shows natural harmonic series of tones having the pitch names C1 and E1, which have the major third interval relationship therebetween. As shown in FIG. 10, the second overtone of a fundamental tone having the pitch name C1 is C2, the third overtone is G2, the fourth overtone is C3, and so on. The second overtone of a fundamental tone having the pitch name E1 is E2, the third overtone is B2, the fourth overtone is E3, and so on. Upon comparison between the natural harmonic series of these two tones, some overtones coincide with each other. For example, the fifth overtone E3 of a tone of the pitch name C1 coincides with the fourth overtone of a tone of the pitch name E1, and the ninth overtone D4 of the tone of the pitch name C1 coincides with the seventh overtone of the tone of the pitch name E1. These overtones have frequencies corresponding to common multiples of the frequencies of the two fundamental tones. The tones having frequencies corresponding to the common multiples of the frequencies of these fundamental tones are those simultaneously produced as resonance tones when two original fundamental tones are produced in, e.g., a piano or a pipe organ.

On the other hand, key codes of overtones having frequencies corresponding to the common multiples can be obtained by adding a predetermined value to the key codes of the fundamental tones. For example, in the case of the fundamental tone C1 (key code=36) and the fundamental tone E1 (key code=40), E3 (key code=64) as the fifth overtone of C1 and as the fourth overtone of E1 can be obtained by adding "28" to the key code "36" of the fundamental tone C1. On the other hand, E3 can also be obtained by adding "24" to the key code "40" of the fundamental tone E1. Such relationships can be similarly applied even if fundamental tones are changed, as long as the interval relationships are left unchanged. For example, a fundamental tone F2 (key code=53) and a fundamental tone A2 (key code=57) have the same major third interval relationship as described above therebetween. In this case, a tone A4 (key code=81) to be produced as a resonance tone can be obtained by adding "28" to the key code "53" of the fundamental tone F2 (or adding "24" to the key code "57" of the fundamental tone A2).

As described above, addends to be added to fundamental tones to obtain key codes of resonance tones in the respective interval relationships can be obtained in advance.

Table 3 below shows addends to be added to a key code of a fundamental tone so as to obtain key codes of resonance tones when keys of tones having the upward minor third, upward major third, upward perfect fourth, and upward perfect fifth interval relationships with a reference tone are depressed. Table 4 below shows addends to be added to a key code of a fundamental tone so as to obtain key codes of resonance tones when keys of tones having the downward minor third, downward major third, downward perfect fourth, and downward perfect fifth interval relationships with a reference tone are depressed.

TABLE 3

| Relationship between Two Tones | Addend to Key Code | Example | Fundamental Tone | Harmonic Overtone | Pitch Name | Error based on Temperament |
|---|---|---|---|---|---|---|
| Upward Minor Third | 31 | C1 → D#1 | C1 | 6 | G3 | 16 |
| | | | D#1 | 5 | | |
| | 34 | | C1 | 7 | A3 | |
| | | | D#1 | 6 | | |
| | 43 | | C1 | 12 | G4 | 16 |
| | | | D#1 | 10 | | |
| Upward Major Third | 28 | C1 → E1 | C1 | 5 | E3 | 14 |
| | | | E1 | 4 | | |
| | 38 | | C1 | 9 | D4 | 35 |
| | | | E1 | 7 | | |
| | 40 | | C1 | 10 | E4 | 14 |
| | | | E1 | 8 | | |
| Upward Perfect Fourth | 24 | C1 → F1 | C1 | 4 | C3 | 2 |
| | | | F1 | 3 | | |
| | 36 | | C1 | 8 | C4 | 2 |
| | | | F1 | 6 | | |
| | 43 | | C1 | 12 | G4 | 1 |
| | | | F1 | 9 | | |
| Upward Perfect Fifth | 19 | C1 → G1 | C1 | 3 | G2 | 2 |
| | | | G1 | 2 | | |
| | 31 | | C1 | 6 | G3 | 2 |
| | | | G1 | 4 | | |
| | 38 | | C1 | 9 | D4 | 1 |
| | | | G1 | 6 | | |

TABLE 4

| Relationship between Two Tones | Addend to Key Code | Example | Fundamental Tone | Harmonic Overtone | Pitch Name | Error based on Temperament |
|---|---|---|---|---|---|---|
| Downward Minor Third | 28 | C1 → A0 | A0 | 6 | E3 | 16 |
| | | | C1 | 5 | | |
| | 31 | | A0 | 7 | G3 | |
| | | | C1 | 6 | | |
| | 40 | | A0 | 12 | E4 | 16 |
| | | | C1 | 10 | | |
| Downward Major Third | 24 | C1 → G#0 | G#0 | 5 | C3 | 14 |
| | | | C1 | 4 | | |
| | 34 | | G#0 | 9 | A#3 | 35 |
| | | | C1 | 7 | | |
| | 36 | | G#0 | 10 | C4 | 14 |
| | | | C1 | 8 | | |
| Downward Perfect Fourth | 19 | C1 → G0 | G0 | 4 | G2 | 2 |
| | | | C1 | 3 | | |
| | 31 | | G0 | 8 | G3 | 2 |
| | | | C1 | 6 | | |
| | 38 | | G0 | 12 | D4 | 1 |
| | | | C1 | 9 | | |
| Downward Perfect Fifth | 12 | C1 → F0 | F0 | 3 | C2 | 2 |
| | | | C1 | 2 | | |
| | 24 | | F0 | 6 | C3 | 2 |
| | | | C1 | 4 | | |
| | 31 | | F0 | 9 | G3 | 1 |
| | | | C1 | 6 | | |

In the electronic musical instrument of this embodiment, three resonance tones are produced based on each of the above-mentioned interval relationships. For example, when the upward minor third interval relationship is detected, three resonance tones are produced accordingly.

The above tables describe pairs of pitch names having the respective interval relationships therebetween, and pitch names of the corresponding harmonic overtones. However, the pitch names are not limited to these, as a matter of course, and if the interval relationship between two fundamental tones is determined, addends are constant. Note that an "error (cent) based on temperament" in each table means that, for example, even if the frequency of the fundamental tone C1 is multiplied with 6 based on the temperament to obtain G3 as the sixth overtone, the product cannot be exactly equal to G3, and includes an error of 16 cents. Therefore, when musical tone signals of resonance tones are output after the errors are corrected, precise resonance tones can be generated.

By looking up Tables 3 and 4, key codes of resonance tones when keys of, e.g., the pitch names C1, E1, and G1 are depressed are calculated as follows.

When the lowest tone mode is selected as the resonance mode, the reference tone is C1 (key code=36) as the lowest tone. E1 has the upward major third interval relationship with the reference tone C1. Since addends in the upward major third interval relationship are "28", "38", and "40" from Table 3, musical tone signals of the following three resonance tones are generated.

36+28=64 (Pitch Name E3)
36+38=74 (Pitch Name D4)
36+40=76 (Pitch Name E4)

G1 has the upward perfect fifth interval relationship with the reference tone C1. Since addends in the upward perfect fifth interval relationship are "19", "31", and "38" from Table 3, musical tone signals of the following three resonance tones are generated.

36+19=55 (Pitch Name G2)
36+31=67 (Pitch Name G3)
36+38=74 (Pitch Name D4)

On the other hand, if the highest tone mode is selected as the resonance tone mode, the reference tone is G1 (key code=43) as the highest tone. E1 has the downward minor third interval relationship with the reference tone G1. Since addends in the downward minor third interval relationship are "28", "31", and "40" from Table 4, musical tone signals of the following three resonance tones are generated.

43+28=71 (Pitch Name B3)
43+31=74 (Pitch Name D4)
43+40=83 (Pitch Name B4)

C1 has the downward perfect fifth interval relationship with the reference tone G1. Since addend in the downward perfect fifth interval relationship are "12", "24", and "31" from Table 4, musical tone signals of the following three resonance tones are generated.

43+12=55 (Pitch Name G2)
43+24=67 (Pitch Name G3)
43+31=74 (Pitch Name D4)

As described above, key codes of resonance tones according to the interval relationships can be obtained by adding the addends shown in Tables 3 and 4 to the key code of the reference tone.

The coefficient tables, buffers, and the like used in the electronic musical instrument of this embodiment will be described in detail below.

Figure 11:
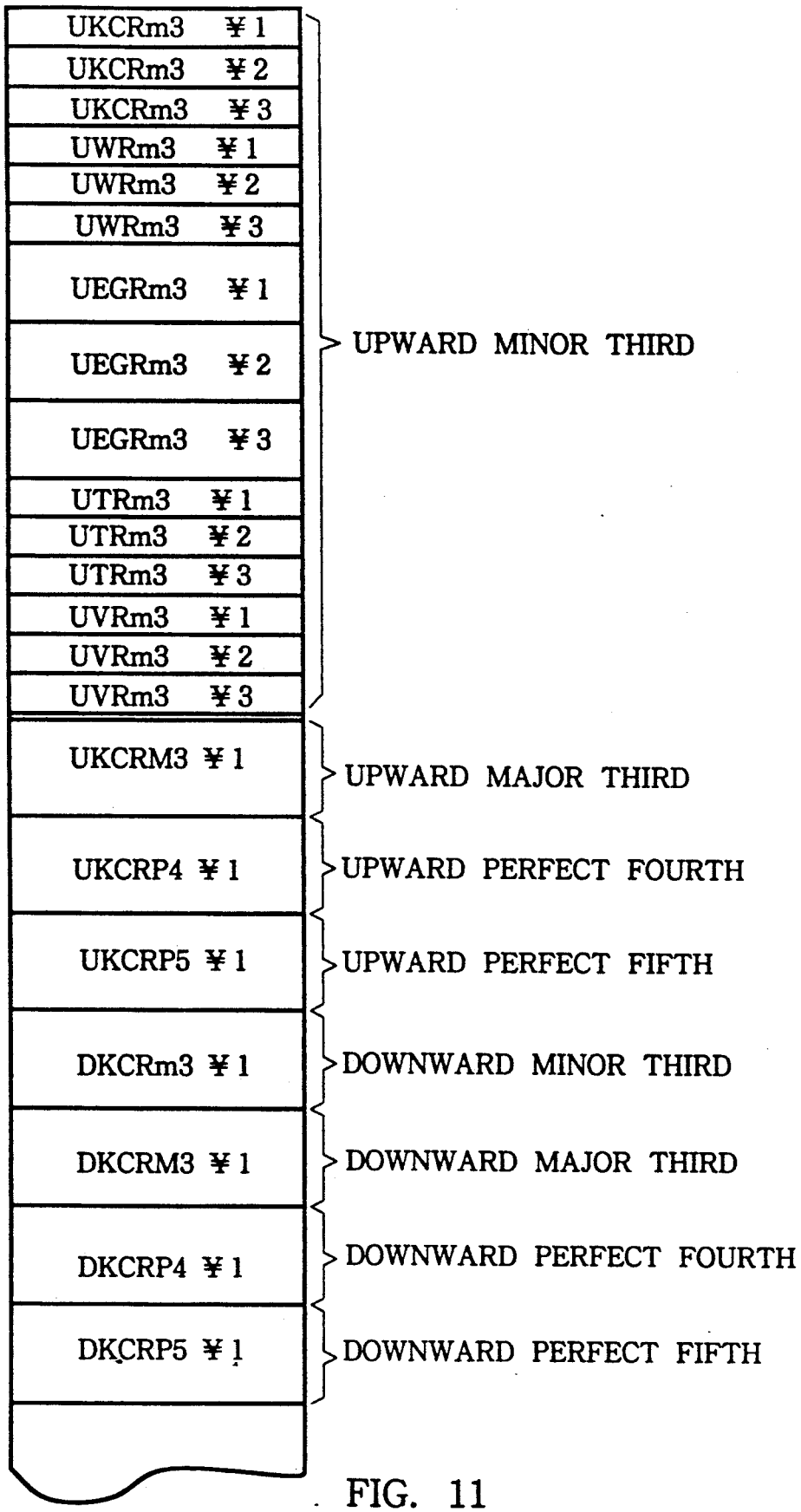
FIG. 11 shows the principle of a coefficient table in a controller of the electronic musical instrument shown in FIG. 7.

FIG. 11 shows the coefficient tables. The coefficient tables are set in units of tone colors. When a tone color is selected, a coefficient table corresponding to the selected tone color is used in processing. Data in the coefficient tables are as follows.

(A) UKCRm3 ¥ 1 to UKCRm3¥ 3

These data are addends for calculating key codes of three resonance tones to be produced when the upward minor third interval relationship is detected. In this case, "31", "34", and "43" are set, as shown in Table 3.

(B) UWRm3¥1 to UWRm3¥3

These data are parameters for designating waveforms (tone colors) of resonance tones to be produced in accordance with the upward minor third interval relationship. When a key code of the resonance tone is inputted as a key code KC to the waveform generator 11 of the tone generation channel 10 shown in FIG. 2, the tone color designation parameter UWRm3¥i (i=1 to 3) is inputted as tone color data TONE to the waveform generator 11.

(C) UEGRm3¥1 to UEGRm3¥3

These data are envelope generator (EG) parameters of resonance tones produced according to the upward minor third interval relationship. When a key code of the resonance tone is inputted as a key code KC to the waveform generator 11 of the tone generation channel 10 shown in FIG. 2, the EG parameter UEGRm3¥1 (i=1 to 3) is inputted as a parameter EGPAR to the amplitude control signal generator 12.

(D) UTRm3¥1 to UTRm3¥3

These data are touch coefficient parameters for defining touch data of resonance tones produced according to the upward minor third interval relationship. When a key code of the resonance tone is inputted as a key code KC to the waveform generator 11 of the tone generation channel 10 shown in FIG. 2, the touch coefficient parameter UTRm3¥i (i=1 to 3) is multiplied with the touch data of an ON key, and the product is inputted to the amplitude control signal generator 12 as touch data TOUCH.

(E) UVRm3¥1 to UVRm3¥3

These data are tone volume coefficient parameters for defining tone volume data of resonance tones produced according to the upward minor third interval relationship. When a key code of the resonance tone is inputted as a key code KC to the waveform generator 11 of the tone generation channel 10 shown in FIG. 2, the tone volume coefficient parameter UVRm3¥i (i=1 to 3) is multiplied with tone volume data of an ON key, and the product is inputted to the amplitude control signal generator 12 as tone volume data VOL.

The above-mentioned data (A) to (E) are the coefficients for the upward minor third interval relationship. Similar coefficients are set for the upward major third, upward perfect fourth, and upward perfect fifth interval relationships, respectively. Since these coefficients are substantially the same as the coefficients (A) to (E) except for the interval relationship, only the symbols will be presented below, and a detailed description thereof will be omitted.

(F) UKCRM3¥1 to UKCRM3¥3

These data are addends ("28", "38", and "40") to obtain key codes of resonance tones corresponding to the upward major third interval relationship.

(G) UWRM3¥1 to UWRM3¥3

These data are waveform (tone color) designation parameters of resonance tones corresponding to the upward major third interval relationship.

(H) UEGRM3¥1 to UEGRM3¥3

These data are EG parameters of resonance tones corresponding to the upward major third interval relationship.

(I) UTRM3¥1 to UTRM3¥3

These data are touch coefficient parameters of resonance tones corresponding to the upward major third interval relationship.

(J) UVRM3Y1 to UVRM3Y3

These data are tone volume coefficient parameters of resonance tones corresponding to the upward major third interval relationship.

(K) UKCRP4¥1 to UKCRP4¥3

These data are addends ("24", "36", and "43") to obtain key codes of resonance tones corresponding to the upward perfect fourth interval relationship.

(L) UWRP4¥1 to UWRP4¥3

These data are waveform (tone color) designation parameters of resonance tones corresponding to the upward perfect fourth interval relationship.

(M) UEGRP4¥1 to UEGRP4¥3

These data are EG parameters of resonance tones corresponding to the upward perfect fourth interval relationship.

(N) UTRP4¥1 to UTRP4¥3

These data are touch coefficient parameters of resonance tones corresponding to the upward perfect fourth interval relationship.

(O) UVRP4¥1 to UVRP4¥3

These data are tone volume coefficient parameters of resonance tones corresponding to the upward perfect fourth interval relationship.

(P) UKCRP5¥1 to UKCRP5¥3

These data are addends ("19", "31", and "38") to obtain key codes of resonance tones corresponding to the upward perfect fifth interval relationship.

(Q) UWRP5¥1 to UWRP5¥3

These data are waveform (tone color) designation parameters of resonance tones corresponding to the upward perfect fifth interval relationship.

(R) UEGRP5¥1 to UEGRP5¥3

These data are EG parameters of resonance tones corresponding to the upward perfect fifth interval relationship.

(S) UTRP5¥1 to UTRP5¥3

These data are touch coefficient parameters of resonance tones corresponding to the upward perfect fifth interval relationship.

(T) UVRP5¥1 to UVRP5¥3

These data are tone volume coefficient parameters of resonance tones corresponding to the upward perfect fifth interval relationship.

Similarly, similar coefficients are set for the downward minor third, downward major third, downward perfect fourth, and downward perfect fifth interval relationships. A description of these coefficients will be omitted since "U" as the start letter of the symbols (A) to (T) need only be changed with "D", and "upward" in the above description need only be read as "downward".

FIG. 12 shows ON key tone key code buffers.

Reference symbol KCNK1 denotes a key code buffer for storing a key code of a new ON key. The buffer KCNK1 corresponds to a 1-byte area. The MSB of the buffer KCNK1 serves as a flag indicating a key ON event when it is "1", and a key OFF state when it is "0". A key code corresponding to a key ON state is stored in the remaining 7 bits.

Reference symbol KCNK2 denotes a reference tone buffer for storing a key code of a reference tone. The buffer KCNK2 corresponds to a 1-byte area like in the buffer KCNK1. The MSB of the buffer KCNK2 is unused, and is always set to be "0". A key code of a reference tone is stored in the remaining 7 bits.

FIG. 13 shows resonance tone key code buffers for storing key codes of resonance tones corresponding to the respective intervals. Each resonance tone key code buffer is a 1-byte area like in the buffer KCNK1. The MSB of this area serves as a flag indicating a key ON state of a resonance tone when it is "1", and a key OFF state of a resonance tone when it is "0". A key code of a resonance tone is stored in the remaining 7 bits.

(A) UKCm3¥1 to UKCm3¥3

These buffers are key code buffers for resonance tones corresponding to the upward minor third interval relationship.

(B) UKCM3¥1 to UKCM3¥3

These buffers are key code buffers for resonance tones corresponding to the upward major third interval relationship.

(C) UKCP4¥1 to UKCP4¥3

These buffers are key code buffers for resonance tones corresponding to the upward perfect fourth interval relationship.

(D) UKCP5¥1 to UKCP5¥3

These buffers are key code buffers for resonance tones corresponding to the upward perfect fifth interval relationship.

(E) DKCm3¥1 to DKCm3¥3

These buffers are key code buffers for resonance tones corresponding to the downward minor third interval relationship.

(F) DKCM3¥1 to DKCM3¥3

These buffers are Key code buffers for resonance tones corresponding to the downward major third interval relationship.

(G) DKCP4¥1 to DKCP4¥3

These buffers are Key code buffers for resonance tones corresponding to the downward perfect fourth interval relationship.

(H) DKCP5¥1 to DKCP5¥3

These buffers are key code buffers for resonance tones corresponding to the downward perfect fifth interval relationship.

The operation of the controller 3 of the electronic musical instrument will be described below with reference to the flow charts shown in FIGS. 14 to 17.

Figure 14:
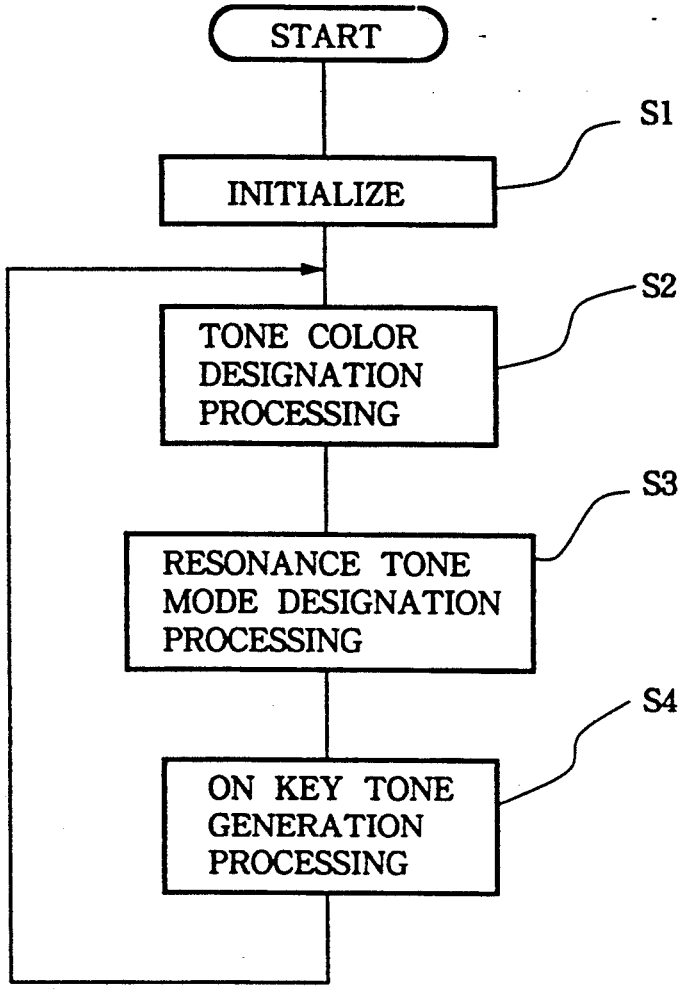
FIG. 14 is a flow chart showing a main routine of the controller of the electronic musical instrument shown in FIG. 7.

FIG. 14 shows the main routine of the controller 3 of this electronic musical instrument. When the operation of the controller 3 is started, registers, tables, and the like are initialized in step S1. After step S1, tone color designation processing is executed in step S2. In the tone color designation processing, it is checked if an operator performs a tone color designation operation. If the operation does not perform the tone color designation operation, the flow directly returns to the main routine; otherwise, switching processing to a designated tone color is executed. In step S3, resonance tone mode designation processing is executed. In the resonance tone mode designation processing, it is checked if an operator performs a resonance tone mode designation operation. If the operator does not perform the resonance tone mode designation operation, the flow returns to the main routine; otherwise, switching processing to a designated resonance tone mode is executed. In step S4, ON key tone generation processing is executed. In the ON key tone generation processing, a musical tone signal corresponding to a key of a detected key ON event is sent to an ON key tone generation channel to produce a tone. In addition, corresponding resonance tones are produced. After step S4, the flow returns to step S2, and the above-mentioned steps are repeated.

Figure 15:
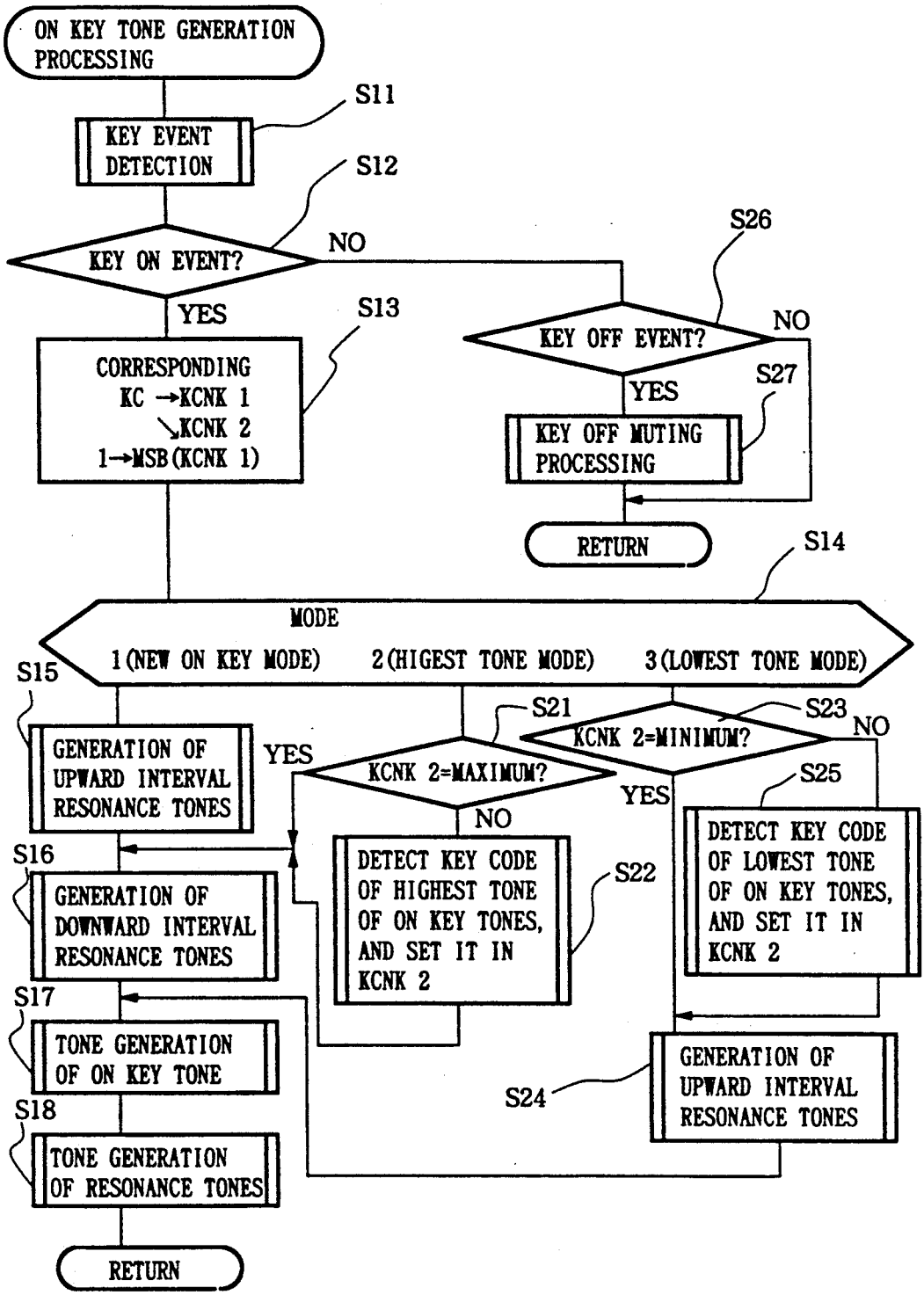
FIG. 15 is a flow chart showing an ON key detection/tone generation processing routine.

The ON key tone generation processing will be described below with reference to the flow chart shown in FIG. 15. In the ON key tone generation processing, a key ON or OFF event is detected in step S11. It is then checked in step S12 if the detected key event is a key ON event. If N in step S12, the flow advances to step S26; otherwise, the flow advances to step S13.

In step S13, a key code KC of a key corresponding to the key ON event (newly depressed key) is set in the key code buffer KCNK1 and the reference tone buffer KCNK2, and the MSB of the key code buffer KCNK1 is set to be "1".

In step S14, a selected resonance tone mode is determined. If the new ON key mode is selected, the flow advances to step S15; if the highest tone mode is selected, the flow advances to step S21; and if the lowest tone mode is selected, the flow advances to step S23.

In step S15, upward interval resonance tone generation processing is executed, and in step S16, downward interval resonance tone generation processing is executed. In the upward interval resonance tone generation processing, an upward interval between the reference tone KCNK2 and another ON key tone is detected, and key codes of resonance tones according to the detected interval are set in predetermined resonance tone key code buffers. In the downward interval resonance tone generation processing, a downward interval between the reference tone KCNK2 and another ON key tone is detected, and key codes of resonance tones according to the detected interval are set in predetermined resonance tone key code buffers. After step S16, the flow advances to step S17.

In step S17, tone generation processing of an ON key tone is executed. In this processing, an empty channel is searched from the ON key tone sound source system, and the key code in the key code buffer KCNK1 is sent to the searched channel. At the same time, predetermined tone color data TONE, key ON signal KON, touch data TOUCH, tone volume data VOL, and EG parameter EGPAR are output to the searched channel. In this manner, the ON key tone is produced.

In step S18, tone generation processing of resonance tones is executed. In this processing, empty channels are searched from the resonance tone sound source system, and resonance tone key codes are sent from the resonance tone key code buffers (FIG. 13) whose MSBs="1" to the searched channels. At the same time, the tone color designation parameters and EG parameters set in the corresponding coefficient tables are outputted to the searched channels as tone color data TONE and parameters EGPAR. Key ON signals KON are also output to the searched channels. Products of touch coefficient parameters set in the corresponding coefficient tables and touch data of an ON key are outputted to the searched channels as touch data TOUCH, and products of tone volume coefficient parameters set in the corresponding coefficient tables and tone volume data of the ON key are outputted to the channels as tone volume data VOL. In this manner, resonance tones are produced.

After step S18, the flow returns to the main routine.

If the highest tone mode is selected, it is checked in step S21 if a key code in the reference tone buffer KCNK2 (which stores a key code of a new ON key in this case) is that of the highest tone of ON keys. If Y in step S21, the flow branches to step S16. If it is determined that the key code in the reference tone buffer KCNK2 is not the highest tone, a key code of the highest tone of the ON keys is detected and is set in the reference tone buffer KCNK2 in step S22. Thereafter, the flow branches to step S16. In the highest tone mode, since the highest tone is used as the reference tone, a downward interval need only be detected.

If the lowest tone mode is selected, it is checked in step S23 if a key code in the reference tone buffer KCNK2 (which stores a key code of a new ON key in this case) is that of the lowest tone of ON keys. If Y in step S23, the flow branches to step S24. In step S24, the upward interval resonance tone generation processing is executed, and the flow then branches to step S17. If it is determined in step S23 that the key code in the reference tone buffer KCNK2 is not the lowest tone, a key code of the lowest tone of the ON keys is detected and is set in the reference tone buffer KCNK2 in step S25. Thereafter, the flow branches to step S24. In the lowest tone mode, since the lowest tone is used as the reference tone, an upward interval need only be detected.

If it is determined in step S12 that the key event is not a key ON event, it is checked in step S26 if the key event is a key OFF event. If Y in step S26, key OFF processing (muting processing) is executed in step S27, and the flow then returns to the main routine. If N in step S26, the flow returns to the main routine.

Figure 16A:
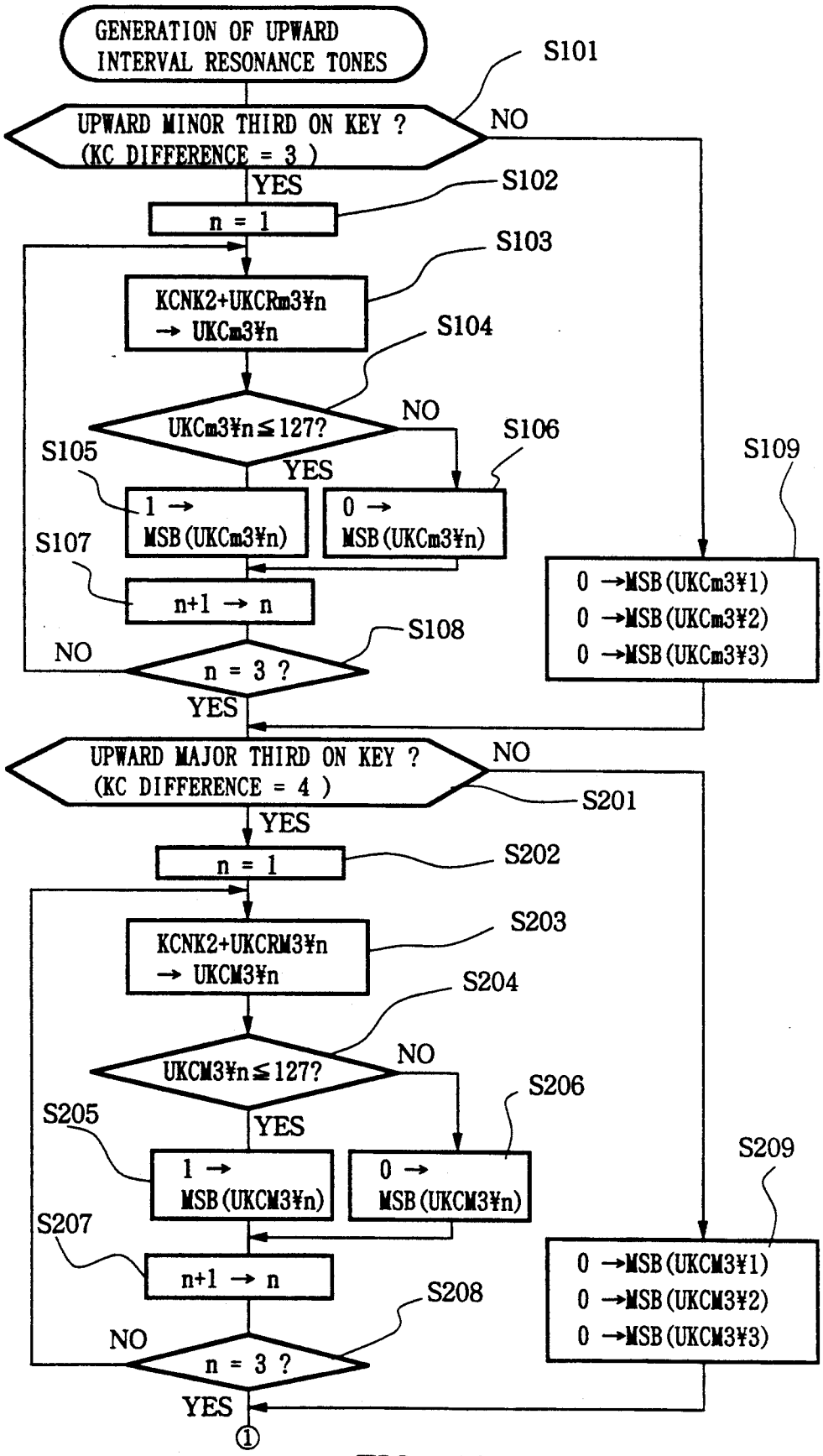
FIGS. 16A, B are a flow chart showing a upward interval resonance tone generation processing routine.
Figure 16B:
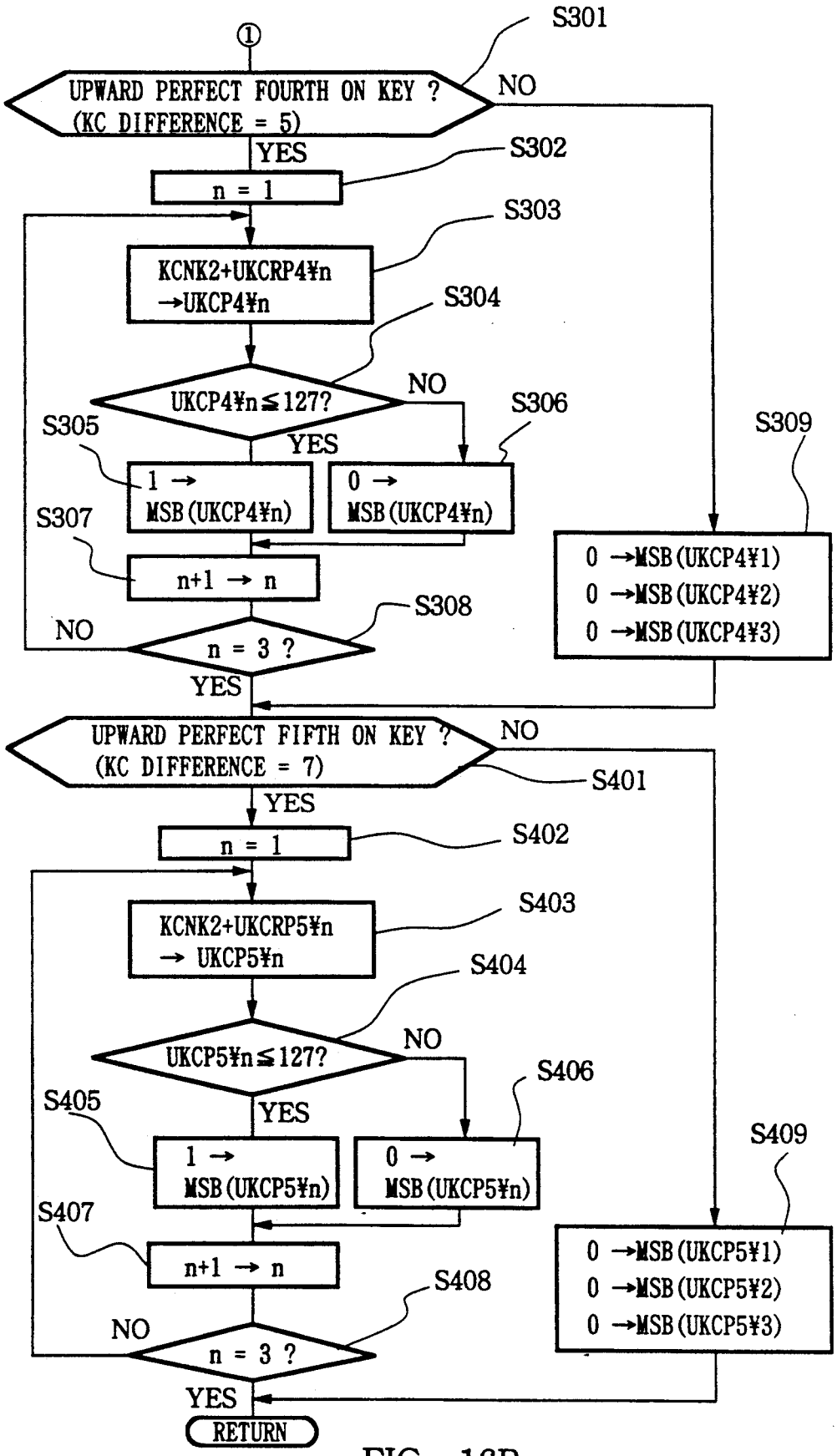

The upward interval resonance tone generation processing will be described below with reference to the flow chart shown in FIG. 16. In the upward interval resonance tone generation processing, it is checked in step S101 if there are ON keys having an upward minor third interval therebetween. This checking step can be attained by subtracting a key code of a reference tone from a key code of an ON key, and checking if the difference between the two key codes is "3". If an ON key having the upward minor third interval is detected, "1" is set in a work register n in step S102. In step S103, an addend UKCRm3 n for a resonance tone corresponding to the upward minor third interval is added to the key code KCNK2 of the reference tone, and the sum is set in the resonance tone key code buffer UKCm3¥n for a resonance tone corresponding to the upward minor third interval.

It is then checked in step S104 if the set key code UKCm3¥n of the resonance tone is equal to or smaller than "127". If Y in step S104, since the corresponding resonance tone can be produced, "1" is set in the MSB of the resonance tone key code buffer UKCm3 n in step S105, and the flow advances to step S107. However, if the set key code exceeds "127", since it is impossible to produce a corresponding tone, "0" is set in the MSB of the resonance tone key code buffer UKCm3¥h in step S105, and the flow advances to step S107.

In step S107, the register n is incremented, and it is then checked in step S108 if the content of the register n has reached "3". If N in step S108, the flow returns to step S103 to execute processing for the next resonance tone. However, if Y in step S108, the flow advances to step S201.

If it is determined in step S101 that no ON keys having the upward minor third interval therebetween are detected, "0" is set in the MSBs of the resonance tone key code buffers UKCm3¥1 to UKCm3¥3 corresponding to the upward minor third interval in step S109, and the flow advances to step S201.

In the processing in steps S101 to S108 described above, it is checked if the upward minor third interval is detected, and if the interval is detected, predetermined resonance tone key codes are set in the resonance tone key code buffers so as to produce corresponding resonance tones.

After step S108, processing for setting key codes of resonance tones corresponding to the upward major third interval (steps S201 to S208), processing for setting key codes of resonance tones corresponding to the upward perfect fourth interval (steps S301 to S308), and processing for setting key codes of resonance tones corresponding to the upward perfect fifth interval (steps S401 to S408) are similarly executed. Of these processing steps, steps having common lower two figures correspond to each other. For example, step S202 corresponds to step S102, step S203 corresponds to step S103, and so on. In the corresponding steps, although different coefficients and areas are used since an interval to be detected is different, since the same processing as in steps S101 to S108 is executed, a detailed description thereof will be omitted.

Figure 17A:
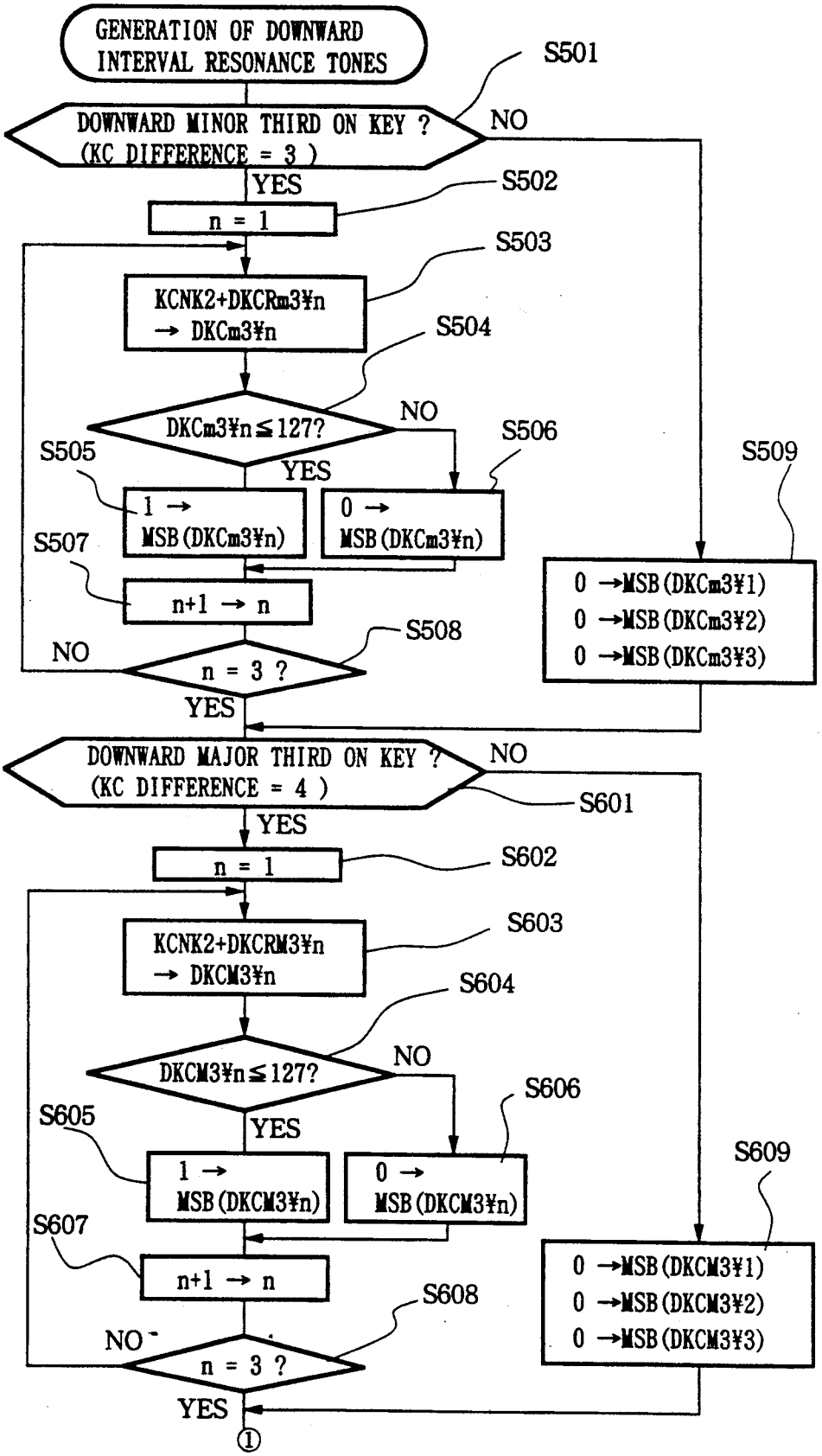
FIGS. 17A, B are a flow chart showing a downward interval resonance tone generation processing routine.
Figure 17B:
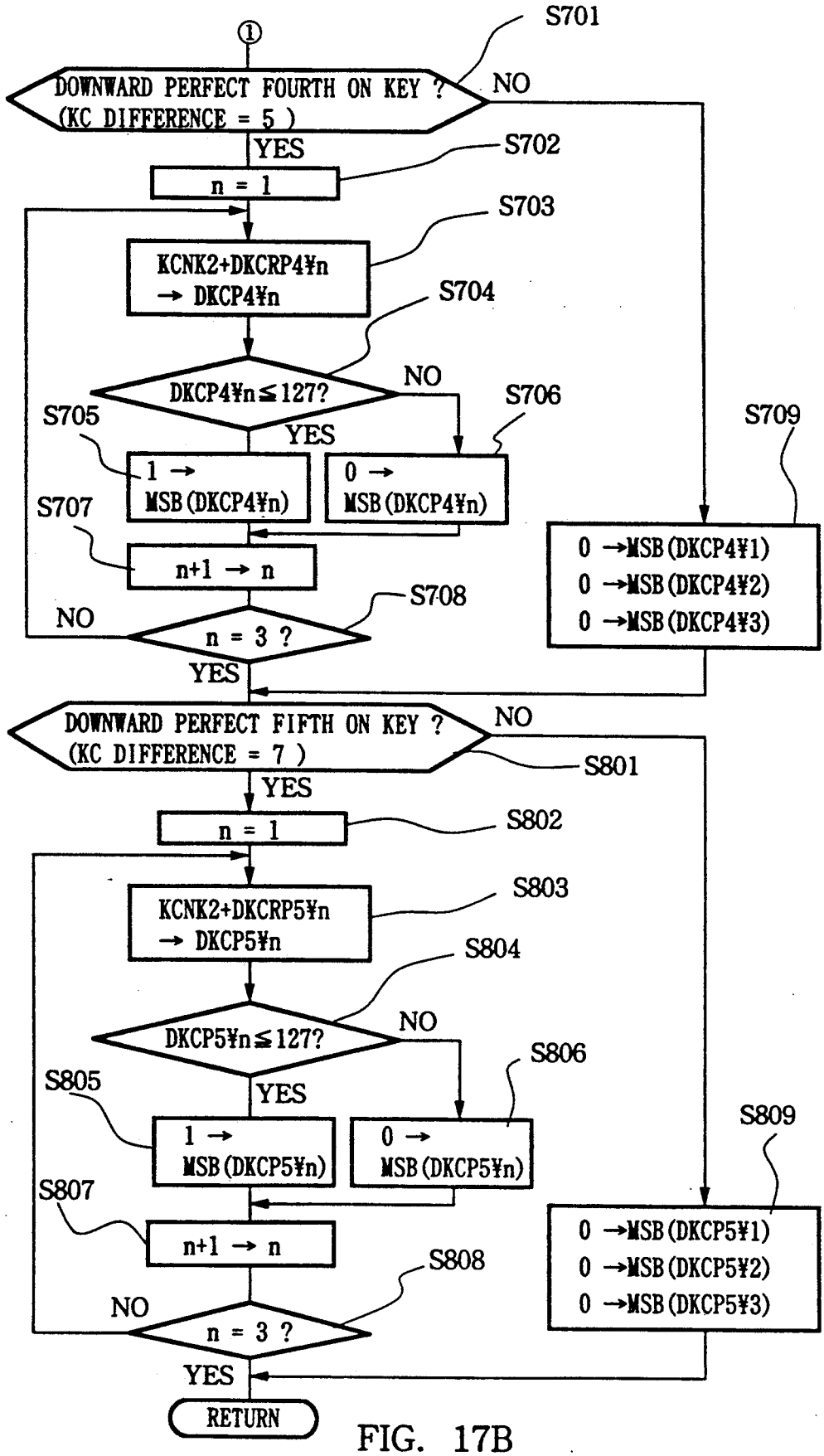
Figure 18:
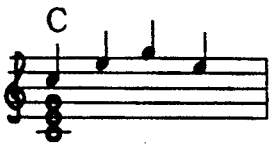
FIG. 18 is a view showing a score for which resonance tones are to be produced.

FIG. 17 is a flow chart showing the downward interval resonance tone generation processing. In steps S501 to S508 in FIG. 17, processing for detecting a downward minor third interval, and for, when the interval is detected, setting predetermined resonance tone key codes in the resonance tone key code buffers so as to generate corresponding resonance tones is performed. This processing is the same as that executed in steps S101 to S108 in FIG. 16. The same applies to processing for setting key codes of resonance tones corresponding to the downward major third interval (steps S601 to S608), processing for setting key codes of resonance tones corresponding to the downward perfect fourth interval (steps S701 to S708), and processing for setting key codes of resonance tones corresponding to the downward perfect fifth interval (steps S801 to S808). Of these processing steps, steps having common lower two figures correspond to each other. For example, step S502 corresponds to step S102, step S503 corresponds to step S103, and so on. In the corresponding steps, although different coefficients and areas are used since an interval to be detected is different, since the same processing as in steps S101 to S108 is executed, a detailed description thereof will be omitted.

In the embodiment described above, upward or downward minor third, major third, perfect fourth, and perfect fifth intervals are detected. However, intervals to be detected are not limited to these, and farther interval relationships may be detected.

As a means for extracting coinciding ones of harmonic overtones of two ON key tones, spectrum analysis (FFT) results may be superposed on each other, and the frequencies of overlapping portions may be detected.

Furthermore, in the above embodiment, the ON key tone generation sound source and the resonance tone generation sound source are separately prepared. However, channel assignment processing of ON key tones and resonance tones may be properly executed, and an integrated sound source may be used.

A method of determining a reference tone is not limited to the above embodiments, and various other methods may be employed.

For example, when a plurality of keys are depressed, a combination of pitches of ON keys (chord) are detected, and the root or a predetermined chord tone of the chord may be used as a reference tone, and an interval between two ON key tones may be obtained.

When a chord can be specified by code detection, a specific tone of the chord may be determined as a reference tone, as described above. On the other hand, when a chord cannot be specified, the highest or lowest (like in the above embodiment).

A resonance tone mode (a method of determining a reference tone or a tone volume) may be changed depending on the total number of ON keys Alternatively, the lowest tone may be used as a reference tone for gorgeous tone colors, and the highest tone may be used as a reference tone for mellow tone colors. In this manner, the reference tones may be changed depending on tone colors.

As described above, according to the second aspect of the present invention, since resonance tone components are generated according to an interval between designated pitches, the overall spectrum structure can be relatively simplified as compared to a case wherein resonance tones are generated in units of ON keys, and the sound in a chord performance state can be prevented from being discordant. If a newly designated pitch is used as a reference pitch, and an interval between this reference pitch and another designated pitch is detected, resonance tones can always be produced according to a music flow, thus preventing generation of a monotonous sound. If resonance tone components are generated and added using the highest tone as a reference tone, a change in sound corresponding to a change in melody can be obtained. Furthermore, if resonance tone components are generated and added using the lowest tone as a reference tone, the depth of sound can be emphasized while preventing a discordant sound of chord tones.

What is claimed is:

1. An electronic musical instrument comprising:

pitch designation means for designating a pitch of a musical tone signal to be generated;

storage means for storing plural series of pitch data in units of pitches which can be designated by said pitch designation means, each of the series of pitch data corresponding to a particular pitch;

detection means operative when a plurality of pitches are designated by said pitch designation means, for detecting at least one coincidence of a pitch data from among the series of pitch data corresponding to the plurality of designated pitches; and musical tone signal output means for outputting a musical tone signal having a pitch designated by said pitch designation means, and for outputting a musical tone signal having a pitch indicated by the coincidence detected by said detection means.

2. An instrument according to claim 1, wherein said detection means further detects the number of occurrences of for any particular unit of pitch data, and said musical tone signal output means controls tone signal controls tone signal characteristics according to the number of occurrences of coincidence to the musical tone signals having the pitch indicated by the particular unit of pitch data, and outputs the obtained musical tone signals.

3. An electronic musical instrument comprising:

pitch designation means for designating pitches of musical tone signals to be generated;

reference pitch determination means for determining a reference pitch among pitches which have been designated by the pitch designation means;

storage means for storing pitch change data to change the reference pitch;

detection means operative when a plurality of pitches are designated by said pitch designation means, for detecting an interval between two particular pitches of the plurality of pitches;

read out means for reading a pitch change data out of said storage means in accordance with the pitch interval detected by the detection means;

pitch change means for changing the reference pitch on the basis of the pitch change data read out by the read out means; and musical tone output means for outputting musical tones having pitches designated by said pitch designation means, and for outputting a musical tone corresponding to the pitch data changed by the pitch change means.

4. An instrument according to claim 3, wherein said reference pitch determination means determines a reference pitch by selecting a pitch from the group consisting of a newly designated pitch, a highest one of the plurality of designated pitches, and a lowest one of the plurality of designated pitches; and said detection means detects an interval between said reference pitch and another designated pitch.

5. An instrument according to claim 3 further comprising mode selecting means for instructing said reference pitch determining means of the criteria according to which said reference pitch determination means determines the reference pitch.

6. An instrument according to claim 3, wherein said storage means stores a musical tone change parameter corresponding to one pitch interval data, in addition to said pitch change data.

7. An instrument according to claim 6, wherein said musical tone change parameter is selected from the group consisting of tone color, envelope data, touch data, and tone volume.

8. An instrument according to claim 3, wherein said musical tone corresponding to the pitch data changed by the pitch change means is a resonance tone common to at least two musical tones necessary for detection in the detection means.

9. An electronic musical instrument comprising:

pitch designation means for designating a pitch of a musical tone signal;

detection means operative when a plurality of pitches are designated by said pitch designation means, for detecting an interval between any two of the plurality of pitches; and musical tone output means for outputting a musical tone which has a pitch designated by said pitch designation means, and for also outputting a resonance tone which has a pitch dependent upon the interval between designations detected by said detection means and corresponding to said two pitches.

* * * * *